US008627754B2

(12) United States Patent
Kasugai et al.

(10) Patent No.: US 8,627,754 B2
(45) Date of Patent: Jan. 14, 2014

(54) SHEET PROCESSING APPARATUS

(75) Inventors: Atsushi Kasugai, Nagoya (JP); Shinji Kobayashi, Tokai (JP); Akira Sago, Seto (JP); Keiji Seo, Nagoya (JP); Takehiko Inaba, Obu (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 1503 days.

(21) Appl. No.: 12/218,796

(22) Filed: Jul. 18, 2008

(65) Prior Publication Data

US 2009/0025524 A1 Jan. 29, 2009

(30) Foreign Application Priority Data

| | | |
|---|---|---|
| Jul. 26, 2007 | (JP) | 2007-194882 |
| Jul. 26, 2007 | (JP) | 2007-194896 |
| Jun. 11, 2008 | (JP) | 2008-152773 |
| Jun. 11, 2008 | (JP) | 2008-152774 |

(51) Int. Cl.
*B41J 11/70* (2006.01)

(52) U.S. Cl.
USPC ..... 83/648; 400/621; 83/649

(58) Field of Classification Search
USPC ..... 400/621, 617, 593, 605; 83/94, 563, 83/694, 649, 648; 101/66, 232
See application file for complete search history.

(56) References Cited

U.S. PATENT DOCUMENTS

| | | | | |
|---|---|---|---|---|
| 3,533,616 | A * | 10/1970 | Bettenhausen | 493/338 |
| 5,468,081 | A * | 11/1995 | Cane et al. | 400/621 |
| 6,113,293 | A * | 9/2000 | Schanke et al. | 400/621 |
| 6,118,469 | A * | 9/2000 | Hosomi | 347/222 |
| 6,652,173 | B1 | 11/2003 | Martini et al. | |
| 7,033,094 | B2 * | 4/2006 | Imai | 400/621 |
| 7,097,373 | B2 | 8/2006 | Mochizuki et al. | |
| 7,354,210 | B2 * | 4/2008 | Seo et al. | 400/621 |
| 7,559,713 | B2 * | 7/2009 | Sugimoto et al. | 400/693 |
| 7,819,599 | B2 * | 10/2010 | Kobayashi et al. | 400/621 |
| 7,857,534 | B2 * | 12/2010 | Watanabe et al. | 400/621 |
| 7,878,724 | B2 * | 2/2011 | Yamagata | 400/664 |
| 7,891,564 | B2 * | 2/2011 | Ito et al. | 235/383 |
| 2007/0065217 | A1 | 3/2007 | Yoshioka | |
| 2009/0028624 | A1 * | 1/2009 | Kobayashi et al. | 400/615.2 |

FOREIGN PATENT DOCUMENTS

| | | |
|---|---|---|
| CN | 1626357 | 6/2005 |
| EP | 1616708 A1 | 1/2006 |
| EP | 1 900 535 | 3/2008 |
| EP | 1 541 363 | 6/2008 |
| EP | 1 559 566 | 8/2008 |
| JP | 4163172 | 6/1992 |

(Continued)

*Primary Examiner* — Omar Flores Sanchez
(74) *Attorney, Agent, or Firm* — McCarter & English, LLP

(57) ABSTRACT

There is provided a sheet processing apparatus capable of preventing the roll sheet cut by the cutting device from falling over to the sheet processing apparatus and improving the conveyance capability of the roll sheet when the long size roll sheet is made. Long size roll sheet is fixed at three spots, wherein the three spots are the top edge portion of the roll sheet receiving portion, the top edge portion on the downstream side of the regulatory member, and the bottom edge portion of the projecting portion. The bottom edge portion of the projecting portion is constructed to be always located inside a circular arc which starts from a center O with a maximum radius R of the roll sheet, wherein the circular arc passes the top edge portion of the roll sheet receiving portion and the top edge portion on the downstream side of the regulatory member.

6 Claims, 13 Drawing Sheets

(56) References Cited

FOREIGN PATENT DOCUMENTS

| | | |
|---|---|---|
| JP | 06032002 | 2/1994 |
| JP | 11005339 | 1/1999 |
| JP | 2000015879 | 1/2000 |
| JP | 2000062251 | 2/2000 |
| JP | 2005212139 | 8/2005 |
| JP | 2005319740 | 11/2005 |

* cited by examiner

SHEET PROCESSING APPARATUS

CROSS-REFERENCE TO RELATED APPLICATIONS

The present application claims priority from Japanese Patent Application No. JP 2007-194882, JP 2007-194896, JP 2008-152773 and JP 2008-152774, filed on Jul. 26, 2007 and Jun. 11, 2008 respectively, the disclosure of which are herein incorporated by reference in their entirety.

TECHNICAL FIELD

The disclosure relates to a sheet processing apparatus having a sheet discharging path portion for discharging sheet with short length in its conveyance direction and sheet that is cut into long size from the roll sheet to the exterior.

BACKGROUND

Conventionally, a variety of sheet processing apparatuses having the sheet discharging mechanism for discharging the cut sheet from the roll sheet discharge slot have been proposed.

For example, there is available a sheet processing apparatus having a discharging device for discharging the roll sheet cut by the cutting device through the feeding force of a pair of roll sheet feeding rollers to the exterior of the printer. In the sheet processing apparatus, the pair of roll sheet feeding rollers is allocated on the downstream side of the cutting device constructed from a movable blade and a fixed blade (for example, see Patent Reference 1).

Patent Reference 1: Japanese Patent Application Laid-open disclosure No. 2000-15879.

And also a variety of sheet processing apparatuses having the cutting device for cutting the long size roll sheet throughout its entire width have been proposed.

For example, there is available a sheet processing apparatus having a slide type cutting device for cutting the roll sheet in its width direction by sliding the movable blade in the width direction of the roll sheet (for example, see Patent Reference 2).

Patent Reference 2: Japanese Patent Application Laid-open disclosure No. 2005-212139.

However, in the printer having a guillotine cutter described in the above-mentioned Patent Reference 1, the sheet discharging roller is equipped on the vicinity of the downstream side of the guillotine cutter. The sheet discharging roller is used to convey the cut printing media to the exterior of the printer. Also a driven roller is provided above the sheet discharging roller, wherein the driven roller is used to convey roll sheet via the cooperation with the sheet discharging roller. As described above, since a pair of roll sheet feeding rollers is provided on the downstream side of the cutting device, the space between the cutting device and the sheet discharging portion is very big, the sheet processing apparatus may not be downsized. As a result, it is difficult to make the sheet processing apparatus thin-modeled, and also the component construction may get complicated.

Accordingly, a compact sheet processing apparatus is thinkable, in which roll sheet cut by the cutting device is discharged from the sheet discharge slot without equipping a pair of roll sheet feeding rollers on the downstream side of the cutting device.

However, in such sheet processing apparatus, since the roll sheet is constructed by laminating the peeling paper via the adhesive agent layer on the base layer, after the roll sheet is cut by the guillotine cutter, the adhesive agent may adhere on the movable blade of the cutter. Thereby, when roll sheet with short length in the conveyance direction is made, the rear end of the short roll sheet may move downward together with the movable blade due to the adherence property of the adhesive agent adhered to the movable blade. Accordingly, the roll sheet may be drawn in to the bottommost end of the cutter due to the adhesive agent adhered to the movable blade, and it may cause the discharging path of the roll sheet blocked up.

And also in the sheet processing apparatus described in the above-mentioned Patent Reference 2, when the end portion at the front side of the long size sheet cut by the cutting device stumbles to the installation surface of the sheet processing apparatus, the sheet is not carried forward, instead the end of the rear side of the sheet may be returned to the cutting device and cause the long size sheet to be cut twice.

SUMMARY

The disclosure has been made to solve the above-described problem and has an object to provide a sheet processing apparatus capable of preventing the short roll sheet from being drawn in to the bottommost end of the cutter due to the adhesive agent adhered to the movable blade when the movable blade is moving, and to provide a sheet processing apparatus capable of discharging the roll sheet cut by the cutting device certainly from the sheet discharge slot, and improving dramatically the discharging capability for roll sheet.

And another object of the disclosure is to provide a sheet processing apparatus capable of preventing the roll sheet cut by the cutting device from falling over to the sheet processing apparatus and preventing the roll sheet being cut twice when the long size roll sheet is made.

To achieve the purpose of the disclosure, according to one aspect of the disclosure, there is provided a sheet processing apparatus comprising: a main body loaded with roll sheet constructed from an adhesive agent layer and a peeling paper which is bonded to the adhesive agent layer; a cutting device for cutting the roll sheet arranged in the main body; a sheet discharging path portion constructing the conveyance path for discharging the roll sheet cut by the cutting device to the exterior, wherein the cutting device comprising: a fixed blade arranged to make a contact with one side face of the roll sheet at an entire width in a width direction, a movable blade arranged capable of being open/close toward the fixed blade, and cut the roll sheet throughout an entire width in the width direction from the other side face of the roll sheet toward the fixed blade, the sheet discharging path portion comprising: a first regulatory member arranged on the movable blade side across the conveyance path for the roll sheet cut by the cutting device, a second regulatory member arranged on the fixed blade side across the conveyance path for the roll sheet cut by the cutting device, one of the first regulatory member and the second regulatory member constructs the bottom side of the sheet discharging path portion, the other of the first regulatory member and the second regulatory member constructs the top side of the sheet discharging path portion, the first regulatory member comprises a first contacting portion with which the roll sheet cut by the cutting device adhered to the movable blade by the adhesive agent makes contact, at the proximity of the cutting device when the movable blade opens, the second regulatory member comprises a second contacting portion with which the roll sheet cut by the cutting device adhered to the movable blade by the adhesive agent makes contact, on the downstream side of the first contacting portion when the movable blade opens, one of the first regulatory member and the second regulatory member constructing the bottom side of the conveyance path comprises a first top edge portion, the first top edge portion being arranged at the proximity of the downstream side of the cutting device in the sheet conveyance direction, one of the first regulatory member and the second regulatory member constructing the bottom side of the conveyance path comprises a second top edge portion, the second top edge portion being arranged on the downstream side of the first top edge portion in the sheet conveyance direction, one of the first regulatory member and the second regulatory member constructing the top side of the conveyance path comprises a bottom edge portion, the bottom edge portion being arranged between the first top edge portion and second top edge portion, the roll sheet cut by the cutting device passes between the first top edge portion and the bottom edge portion, and passes between the second top edge portion and the bottom edge portion, the bottom edge portion exists inside the circular arc which projects toward upside with a predetermined radius, wherein the circular arc passes the first top edge portion and the second top edge portion.

In the sheet processing apparatus mentioned above, the sheet processing apparatus comprises a first regulatory member arranged on the movable blade side across the conveyance path for the roll sheet cut by the cutting device, and a second regulatory member arranged on the fixed blade side across the conveyance path for the roll sheet cut by the cutting device, the first regulatory member comprises a first contacting portion with which the roll sheet cut by the cutting device adhered to the movable blade by the adhesive agent makes contact, at the proximity of the cutting device when the movable blade opens, the second regulatory member comprises a second contacting portion with which the roll sheet cut by the cutting device adhered to the movable blade by the adhesive agent makes contact, on the downstream side of the first contacting portion when the movable blade opens.

Accordingly, the roll sheet adhered to the movable blade may be peeled from the movable blade, especially, the short roll sheet may be discharged certainly without being drawn in by the movable blade, and thus the jam of the roll sheet may be prevented.

Also in the sheet processing apparatus mentioned above, one of the first regulatory member and the second regulatory member constructing the top side of the conveyance path comprises a bottom edge portion, the bottom edge portion being arranged between the first top edge portion and second top edge portion. The roll sheet cut by the cutting device passes between the first top edge portion and the bottom edge portion, and passes between the second top edge portion and the bottom edge portion, the bottom edge portion exists inside the circular arc which projects toward upside with a predetermined radius, wherein the circular arc passes the first top edge portion and the second top edge portion.

Therefore, one surface of the cut long size roll sheet is supported at the first top edge portion and the second top edge portion of the conveyance path member on the rear edge portion of the roll sheet in the sheet conveyance direction, while the other surface of the roll sheet is pressed by the bottom edge portion of the supporting member. As a result, the long size roll sheet with its tip stumbling to the setting surface of the sheet processing apparatus is prevented from falling over to the movable blade due to its own weight, so that the roll sheet may be prevented from being cut twice.

To achieve the purpose of the disclosure, according to the other aspect of the disclosure, there is provided a sheet processing apparatus comprising: a main body loaded with roll sheet constructed from an adhesive agent layer and a peeling paper which is bonded to the adhesive agent layer; a cutting device for cutting the roll sheet arranged in the main body; a sheet discharging path portion constructing the conveyance path for discharging the roll sheet cut by the cutting device to the exterior, wherein the cutting device comprising: a fixed blade arranged to make a contact with one side face of the roll sheet at an entire width in a width direction, a movable blade arranged capable of being open/close toward the fixed blade, and cut the roll sheet throughout an entire width in the width direction from the other side face of the roll sheet toward the fixed blade, the sheet discharging path portion comprising: a first regulatory member arranged on the movable blade side across the conveyance path for the roll sheet cut by the cutting device, a second regulatory member arranged on the fixed blade side across the conveyance path for the roll sheet cut by the cutting device, the first regulatory member comprises a first contacting portion with which the roll sheet cut by the cutting device makes contact on the vicinity of the cutting device when the movable blade on which the roll sheet cut by the cutting device is adhered to by the adhesive agent moves to open, the second regulatory member comprises a second contacting portion with which the roll sheet cut by the cutting device makes contact on the downstream side of the first contacting portion when the movable blade on which the roll sheet cut by the cutting device is adhered to by the adhesive agent moves to open.

In the sheet processing apparatus mentioned above, the sheet processing apparatus comprises a first regulatory member arranged on the movable blade side across the conveyance path for the roll sheet cut by the cutting device, and a second regulatory member arranged on the fixed blade side across the conveyance path for the roll sheet cut by the cutting device, the first regulatory member comprises a first contacting portion with which the roll sheet cut by the cutting device makes contact on the vicinity of the cutting device when the movable blade on which the roll sheet cut by the cutting device is adhered to by the adhesive agent moves to open, the second regulatory member comprises a second contacting portion with which the roll sheet cut by the cutting device makes contact on the downstream side of the first contacting portion when the movable blade on which the roll sheet cut by the cutting device is adhered to by the adhesive agent moves to open.

Thereby, the roll sheet adhered to the movable blade may be peeled from the movable blade, especially, the short roll sheet may be discharged certainly without being drawn in by the movable blade, and thus the jam of the roll sheet may be prevented.

To achieve the purpose of the disclosure, according to another aspect of the disclosure, there is provided a sheet processing apparatus comprising: a main body loaded with roll sheet; a cutting device for cutting the roll sheet arranged in the main body; a discharging mechanism for discharging the roll sheet cut by the cutting devices to the exterior, wherein the discharging mechanism comprises: a conveyance path member, a supporting member, a first top edge portion of the conveyance path member, a second top edge portion of the conveyance path member, and a bottom edge portion of supporting member, wherein the discharging mechanism is arranged on the downstream side of the cutting device, the conveyance path member constructs the conveyance path for discharging the roll sheet cut by the cutting device, and conveys the roll sheet cut by the cutting device, the supporting member facing the conveyance path member constructs the conveyance path, the first top edge portion of the conveyance path member is arranged on the downstream side of the cutting device in the sheet conveyance direction, the second top edge portion of the conveyance path member is arranged on the downstream side of the first top edge portion of the conveyance path member in the sheet conveyance direction, the bottom edge portion of supporting member is between first top edge portion and the second top edge portion of the conveyance path member, the roll sheet cut by the cutting device passes between the first top edge portion of the conveyance path member and the bottom edge portion of supporting member, and passes between the second top edge portion of the conveyance path member and the bottom edge portion of supporting member, the bottom edge portion of supporting member exists inside the circular arc which projects to a top side with a predetermined radius, wherein the circular arc passes the first top edge portion and the second top edge portion of the conveyance path member.

In the sheet processing apparatus mentioned above, the discharging mechanism comprises a conveyance path member for conveying the cut sheet, and a supporting member facing to the conveyance path member, wherein the conveyance path member includes a first top edge portion and a second top edge portion, and the supporting member includes a bottom edge portion, both the conveyance path member and the supporting member construct the conveyance path of the roll sheet. The roll sheet cut by the cutting device passes between the first top edge portion of the conveyance path member and the bottom edge portion of supporting member, and also passes between the second top edge portion of the conveyance path member and the bottom edge portion of supporting member. Therefore, one surface of the cut long size roll sheet is supported at the first top edge portion and the second top edge portion of the conveyance path member on the rear edge portion of the roll sheet in the sheet conveyance direction, while the other surface of the roll sheet is pressed by the bottom edge portion of the supporting member. As a result, the long size roll sheet with its tip stumbling to the setting surface of the sheet processing apparatus is prevented from falling over to the movable blade due to its own weight, so that the roll sheet may be prevented from being cut twice.

DETAILED DESCRIPTION

Figure 1:
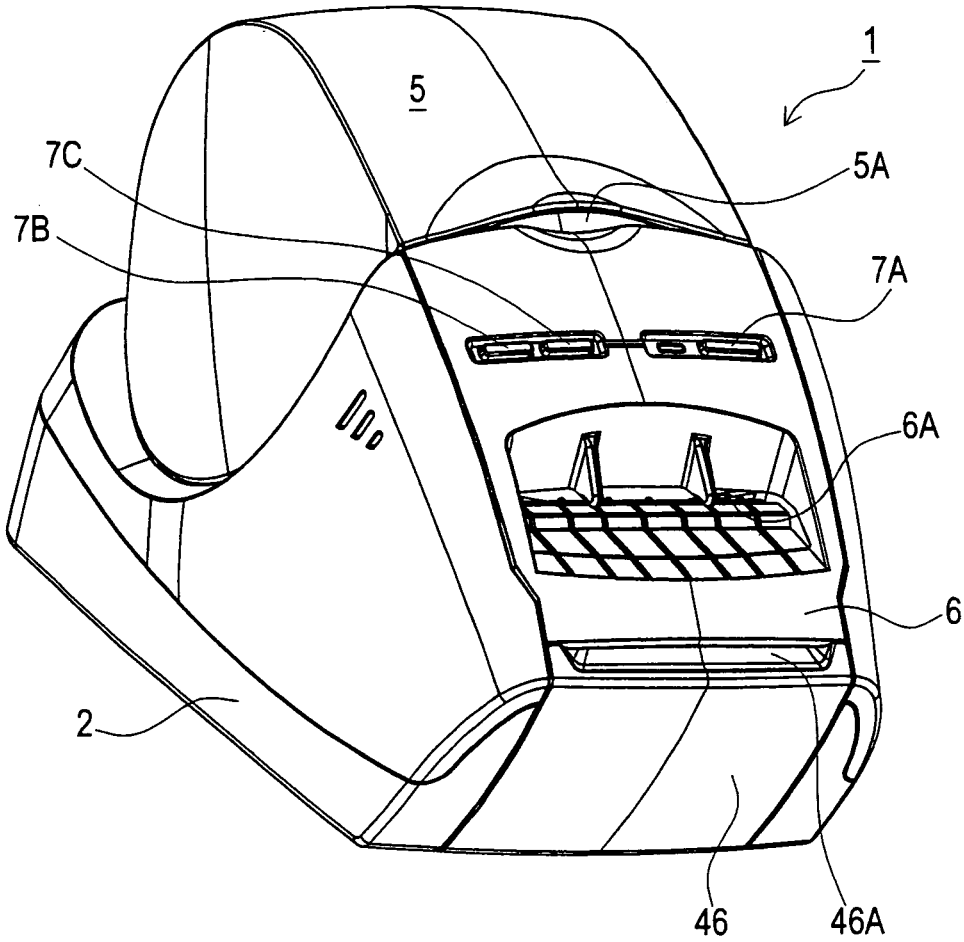
FIG. 1 is a perspective view of an appearance of a printing apparatus according to the embodiment as seen from its front face.

A detailed description of an exemplary embodiment of a printing apparatus of the disclosure will now be given referring to the accompanying drawings.

Hereinafter, an exemplary embodiment of a printing apparatus of the disclosure will be described in detail with reference to the drawings.

First, the schematic structure of the printing apparatus loaded with a roll sheet holder according to the embodiment will be described based on FIGS. 1 to 6.

As shown in FIGS. 1 to 6, in the printing apparatus 1, a main body case 2 and a roll sheet holder 3 are accommodated in a roll sheet holder accommodating portion 4. A non-specified length roll sheet 3A (hereinafter referred to as "roll sheet 3A") with a predetermined width is wound on the roll sheet holder 3. The top portion of the printing apparatus 1 is covered with a top cover 5 made of resin, the cover being attached to the top edge portion on the rear side so that it can be opened or closed freely.

A front cover 6 is formed on the front side of the top cover 5. A power button 7A, a feed button 7B and a cut button 7C are provided on the top end portion of the front cover 6 (central part in FIG. 1). The feed button 7B discharges a predetermined length of the roll sheet 3A in a conveyance direction while it is kept pressed, and the cut button 7C cuts the roll sheet 3A by driving the cutter unit 8 (see FIG. 7) covered with the front cover 6 when it is pressed. The front cover 6 includes a sheet discharge slot 6A for discharging the printed roll sheet 3A to the exterior on the front end portion.

Figure 3:
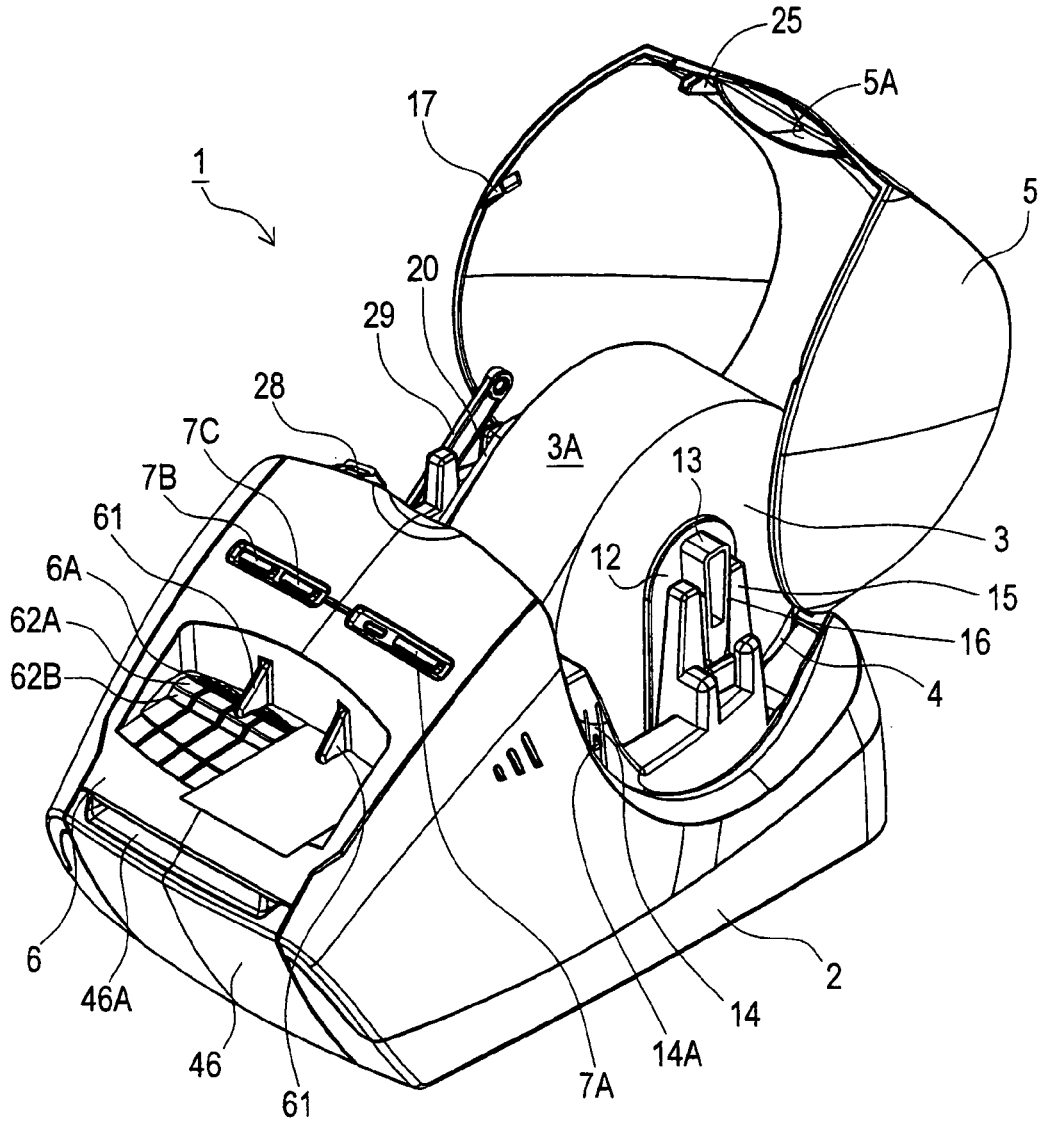
FIG. 3 is a perspective view showing a condition in which a roll sheet is loaded in the printing apparatus according to the embodiment by opening a top cover, as seen from above to the right.
Figure 5:
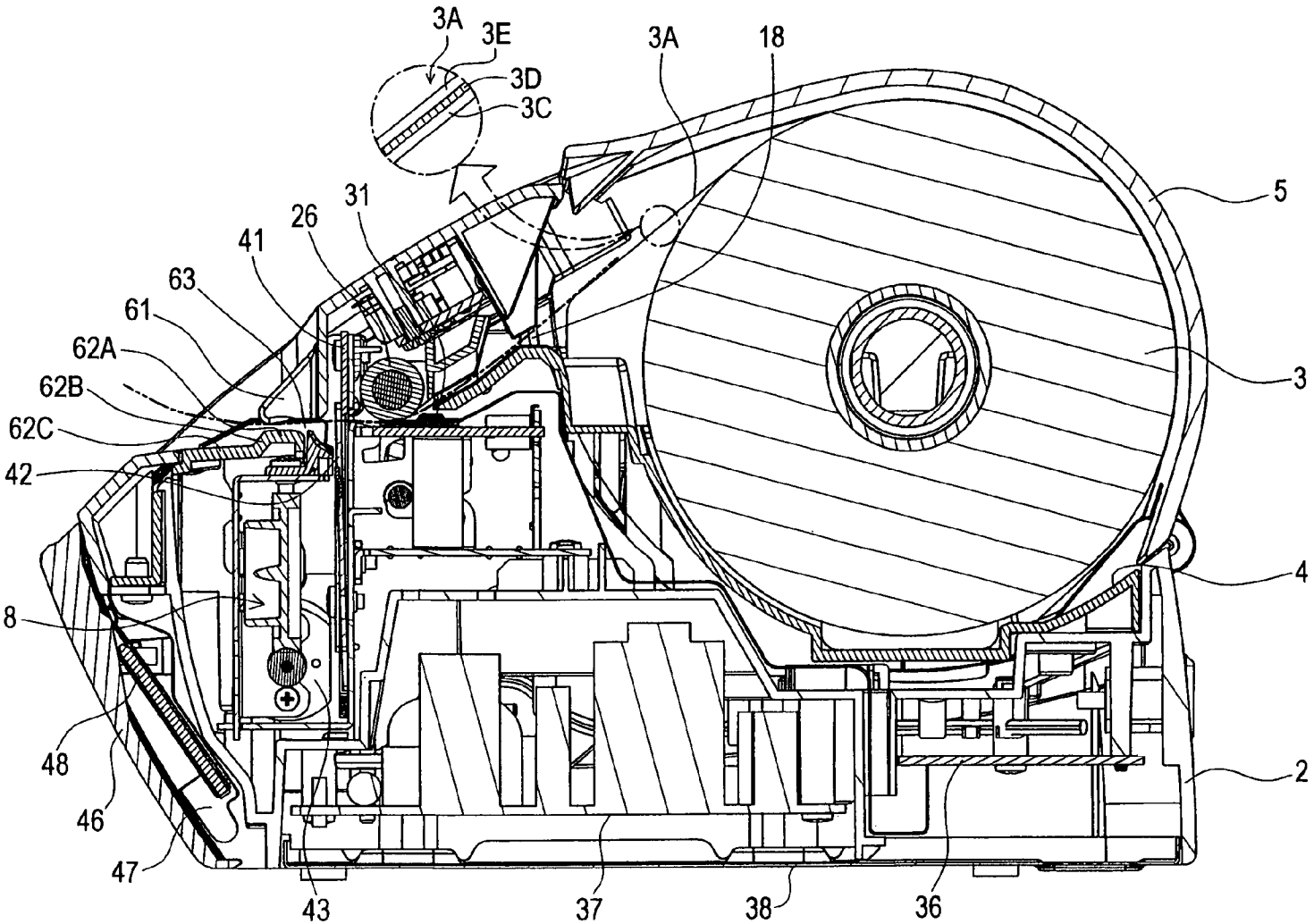
FIG. 5 is a side sectional view showing a condition in which the roll sheet holder is loaded in the printing apparatus according to the embodiment.

As shown in FIG. 1, FIG. 3 and FIG. 5, the front side of the front cover 6 is covered by a tray member 46. The tray member 46 is attached on the bottom end portion of the front cover 6 so as to be opened or closed freely. A concave portion 46A is formed on the top end of the tray member 46. The tray member 46 may be opened by putting fingers at the concave portion 46A and moving the tray member 46 rotationally to a front side of the printing apparatus 1. As shown in FIG. 5, a tray accommodating portion 47 is formed in the inner side of the tray member 46. The tray accommodating portion 47 is accommodated in a locking state to the tray member 46 by moving a discharging tray 48 rotationally to the inner side of the tray member 46. When the tray member 46 is opened, among the roll sheet 3A discharged from the sheet discharge slot 6A, the roll sheet 3A which slides down from the surface of the front cover 6 are received on the tray member 46.

Figure 2:
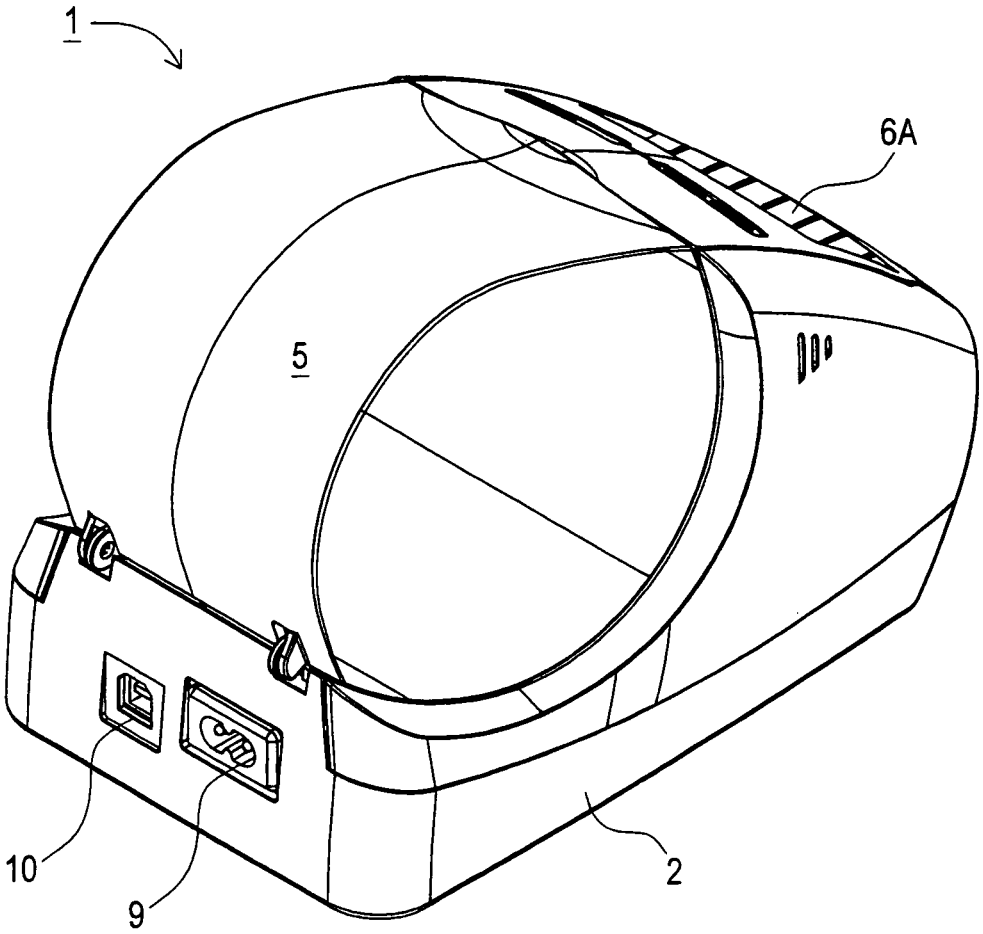
FIG. 2 is a perspective view of an appearance of the printing apparatus according to the embodiment as seen from its rear face.

As shown in FIG. 2, an inlet 9 to which a power cord (not shown) is connected is disposed on the right side end portion of the rear face portion of the main body case 2. And a universal serial bus (USB) connector 10 connected to a personal computer (not shown) is provided on the left side end portion of the rear face portion of the main body case 2.

As shown in FIG. 5, the roll sheet 3A is constituted by bonding together a long size heat sensitive sheet (so-called thermal paper) 3C and a peeling paper 3E via an adhesive agent layer 3D. The heat sensitive sheet 3C has self color generating characteristic, and the adhesive agent layer 3D is provided on the rear surface of the heat sensitive sheet 3C. The roll sheet 3A is wound around the roll sheet holder 3 so that the printing surface of the heat sensitive sheet 3C is located inside.

As shown in FIG. 3, the roll sheet holder 3 has a positioning member 12. An attachment member 13 having a substantially rectangular cross section is projected outward from the positioning member 12. The printing apparatus 1 has a holder supporting member 15 which may support the roll sheet holder 3 on a side end portion (the right side end portion in FIG. 3) in a substantially vertical direction to the conveyance direction of the roll sheet holder accommodating portion 4. This holder supporting member 15 includes a first positioning groove portion 16 formed in a substantially longitudinally long U shape in its front view. The first positioning groove portion 16 is open upward in the width direction and at the same time open to both sides in the width direction.

Figure 6:
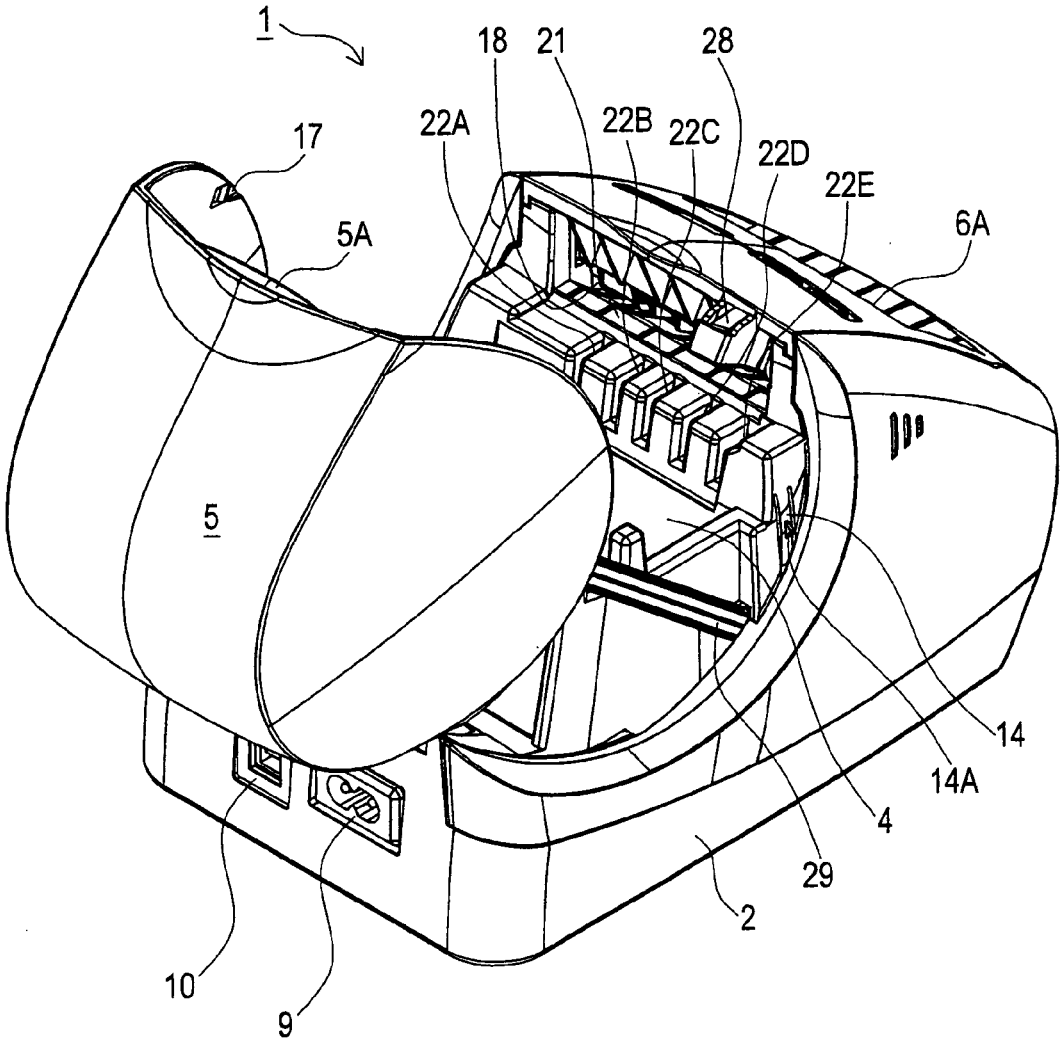
FIG. 6 is a schematic perspective view showing a condition in which the roll sheet is unloaded and the top cover of the printing apparatus according to the embodiment is opened as seen from above to the left behind.

The roll sheet holder 3 has a guide member 20 (see FIG. 3). As shown in FIG. 6, a loading portion 21 on which the tip end portion of the guide member 20 is to be placed is provided in the roll sheet holder accommodating portion 4. The loading portion 21 is extended substantially horizontally from the rear end portion of an insertion port 18 (see FIG. 5) toward the top end portion on the front side of the roll sheet holder accommodating portion 4. The insertion port 18 is a portion to which the roll sheet 3A is to be inserted. Five second positioning groove portions 22A to 22E are formed at an edge corner portion on the rear side in the conveyance direction of this loading portion 21. The five second positioning groove portions 22A to 22E have a substantially L-shaped section corresponding to a plurality of width dimensions of the roll sheet 3A. As shown in FIG. 5, the second positioning groove portions 22A to 22E are formed so that the bottom end portion on the front end to come into contact with the loading portion 21 of the guide member 20 constituting the load sheet holder 3 can be fitted thereto from above.

Figure 4:
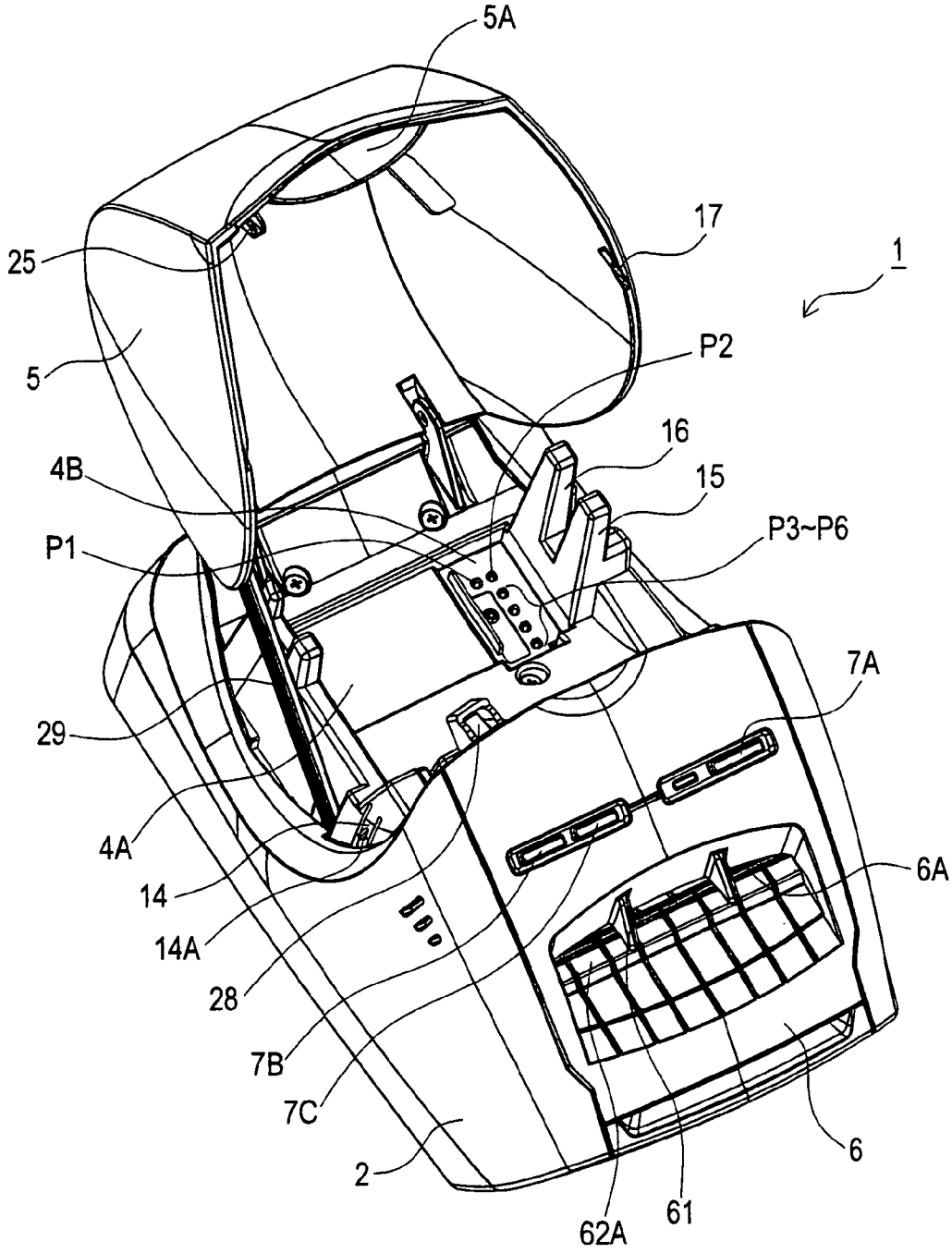
FIG. 4 is a perspective view showing a condition in which the roll sheet is unloaded in the printing apparatus according to the embodiment by opening the top cover as seen from above to the left.

As shown in FIG. 4, a position determining concave portion 4A is formed in a predetermined depth (about 1.5 to 3 mm in this embodiment) in the bottom portion of the roll sheet holder accommodating portion 4. The position determining concave portion 4A has a landscape quadrangle shape in its plan view. The position determining concave portion 4A is formed substantially vertically to the conveyance direction from the inside proximal end portion of the holder supporting member 15 up to the proximal end portion of an opposing side face. Further, a determining concave portion 4B is formed on the inside proximal end of the holder supporting member 15 of the position determining concave portion 4A. The determining concave portion 4B has a rectangular shape with a longer side along the conveyance direction as seen in its plan view. And a portion opposing a sheet determining portion (not shown) extends inward substantially at right angle from the bottom end portion of the positioning portion 12. And this extending portion of the determining concave portion 4B is more deeply formed than that of the position determining concave portion 4A by a predetermined depth (a depth of about 1.5 to 3 mm in this embodiment).

This determining concave portion 4B includes six sheet determining sensors P1, P2, P3, P4, P5, P6 arranged in an L-shape. Each sheet determining sensor is constituted of push type micro switch or the like in order to determine the type of the roll sheet 3A and material of the heat sensitive sheet 3C, the width of the roll sheet 3A and the like. In the meantime, the six sheet determining sensors P1 to P6 are indicated in FIG. 4.

The sheet determining sensors P1 to P6 are constituted of a known mechanical switch composed of a plunger, micro switch and the like. And the top end portion of each plunger is provided to project from the bottom face portion of the determining concave portion 4B toward the vicinity of the bottom face portion of the position determining concave portion 4A. To each of the sheet determining sensors P1 to P6, it is determined whether or not a sensor hole (not shown) is formed. Each sensor hole is formed in a sheet determining portion which extends inward substantially at right angle from the bottom end portion of the positioning member 12. And plural parameters are detected based on the ON or OFF signals of the sensor holes. These parameters include the type of the roll sheet 3A loaded in the roll sheet holder 3, material of the heat sensitive sheet 3C, width of the roll sheet 3A and the like.

In each sheet determining sensor P1 to P6 according to the embodiment, its plunger is projected up to the vicinity of the bottom face of the position determining concave portion 4A from the bottom face of the determining concave portion 4B, thus the micro switch is kept OFF normally. Then, when each sensor hole in the sheet determining portion is located at a position opposing each of the sheet determining sensors P1 to P6, the plunger is not pressed so that the micro switch is kept off and thus, an "OFF" signal is output. On the other hand, if each sensor hole in the sheet determining portion is not located at a position opposing each of the sheet determining sensors P1 to P6, the plunger is pressed down to turn the micro switch to an "ON" state and then an "ON" signal is output. Thus, each of the sheet determining sensors P1 to P6 outputs 6-bit "0", "1" signals. And when the sheet determining sensors P1 to P6 are all in a "OFF" state, namely, no roll sheet is mounted on the roll sheet holder 3, a 6-bit signal of "000000" is output.

A side end portion (right end portion in FIG. 3) on the side of the holder supporting member 15 of the insertion port 18 is formed at a position opposing the inside end face of the positioning member 12, which is to be fitted to the holder supporting member 15. Thereby, the roll sheet holder 3 on which the roll sheet 3A is loaded is detachably mounted in the roll sheet holder accommodating portion 4. As shown in FIG. 6, the roll sheet holder 3 is mounted by fitting the attachment member 13 of the positioning member 12 into the first positioning groove portion 16 of the holder supporting member 15. And a bottom end portion of the front end of the guide member 20 is fitted into any of second positioning groove portions 22A to 22E so that the bottom end portion of the guide member 20 is fitted into a positioning concave portion 4A to make a contact therewith.

As shown in FIG. 4, a slide member 29 is provided on the other side end portion of the holder supporting member 15 in the roll sheet holder accommodating portion 4. The slide member 29 is attached to the side end portion of the main body case 2 (left side end portion in FIG. 4) and supports the top cover 5. The slide member 29 may execute the up and down movement operation of the after-mentioned thermal head 31 while supporting the top cover 5 when it is slid.

As shown in FIG. 5, a platen roller 26 is supported rotatably on the bottom side of the front end portion of the front cover 6. A thermal head 31 is provided on the bottom side of the platen roller 26. The up and down movement operation of thermal head 31 is executed by the slide member 29. The roll sheet 3A is printed between the platen roller 26 and the thermal head 31. In other words, when the top cover 5 is closed by sliding the slide member 29, the thermal head 31 is moved upward, and the roll sheet 3A is depressed against the platen roller 26 so as to enable printing to be carried out.

As shown in FIG. 3 and FIG. 4, on the left and right side wall of the front side of the roll sheet holder accommodating portion 4, an elastic locking part 14 is provided. Each of the elastic locking parts 14 is capable to deform elastically to the inner side of the roll sheet holder accommodating portion 4. And a locking projection 14A is formed respectively on each elastic locking part 14. The locking projection 14A having a triangle sectional side view projects toward an outside direction of the locking part 14. Each elastic locking part 14 is adapted to engage with each locking concave portion 17 formed on the side edge portion of the opening portion on the top cover 5. One of the locking concave portions 17 is shown in FIG. 3, and the other locking concave portion 17 is shown in FIG. 4.

Consequently, each elastic locking part 14 is engaged with each locking concave portion 17 respectively by moving the top cover 5 rotationally to a front side direction. Thus, the top cover 5 is maintained in a closed state. And a concave portion 5A is formed at the central portion of the front end on the top cover 5. When user puts fingers on the concave portion 5A to move the top cover 5 rotationally to a rear side direction, the engagement between each elastic locking part 14 and each locking concave portion 17 is released. Thus, the top cover 5 is enabled to be opened.

A pushing pawl portion 25 is provided on the left side of the front face of the concave portion 5A on the top cover 5. The pushing pawl portion 25 projects a predetermined length to a front side direction. A top cover detecting switch 28 is provided on the position which comes into contact with the pushing pawl portion 25 on the main body case 2 when the top cover 5 is closed. The top cover detecting switch 28 is constituted of micro switch and the like. The top cover detecting switch 28 may detect whether it is pressed by the pushing pawl portion 25 or not. In other words, top cover detecting switch 28 may detect whether the top cover 5 is closed or not.

On the other hand, when the top cover 5 is opened, the pushing pawl portion 25 is disengaged from the top cover detecting switch 28. In conjunction with the opening of the top cover 5 by the slide member 29 which is attached with the top cover 5, the thermal head 31 is moved downward, and disengages from the platen roller 26.

As shown in FIG. 5, a control board 36 is provided on the bottom side of the roll sheet holder accommodating portion 4. On the control board 36, a control circuit portion is formed to drive control each mechanical component based on an instruction from an exterior personal computer and the like. A power supply board 37 on which a power circuit portion is formed is provided on the bottom side of the thermal head 31. Then, the control board 36 and the power supply board 37 are covered with a bottom face cover 38 which is screwed to the bottom face portion thereof. And the bottom face cover 38 is made of thin steel plate (steel plate so as SPCC about 0.5 mm thick in this embodiment).

When the top cover 5 is closed as shown in FIG. 5, the thermal head 31 is moved upward so that the roll sheet 3A is depressed against the platen roller 26 to enable printing to be carried out. In other words, the thermal head 31 comes into contact with the printing surface of heat sensitive sheet 3C on the roll sheet 3A. Thus the printing of the characters and the like is executed by heating the heat sensitive sheet 3C. Then the printed roll sheet 3A is carried to the cutter unit 8 which is provided on the downstream side of the thermal head 31, and is cut by the cutter unit 8.

Figure 7:
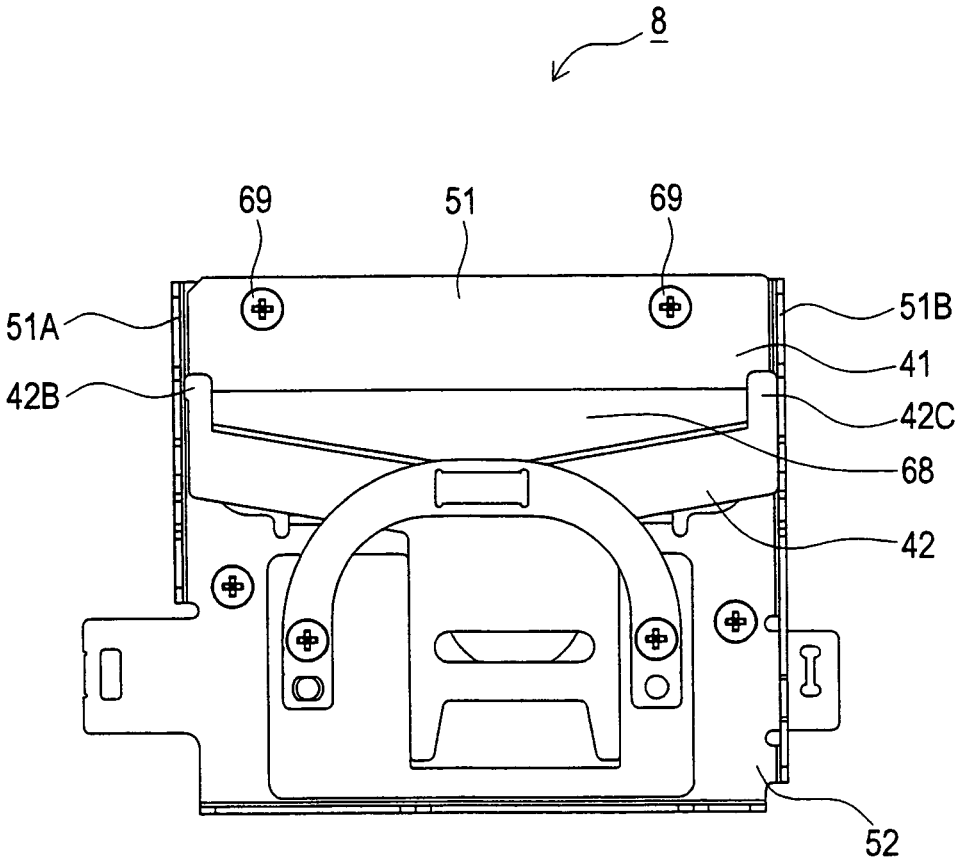
FIG. 7 is a front view of a cutter unit in the printing apparatus according to the embodiment.

Next, the schematic structure of the cutter unit 8 will be described with reference to FIG. 7. FIG. 7 is a front view of a cutter unit of the printing apparatus according to the embodiment. As shown in FIG. 7, the cutter unit 8 comprises a rear frame 51 and a front frame and the like. The rear frame 51, on which the fixed blade 41 and the like are fixed, is formed in U shape in its plan view, and is disposed on the rear side in the conveyance direction. The front frame 52, on which the cutting motor 43 and the like are fixed, covers the front side of the rear frame 51 in the conveyance direction.

The cutter unit 8 is constructed from a fixed blade 41 and a movable blade 42 which is shaped in a letter V in its front view. When the cut button 7C is pressed, the movable blade 42 is reciprocated in the vertical direction controlled by a cutting motor 43 (see FIG. 8). The cutting motor 43 is constructed from a DC motor and the like. The roll sheet 3A is cut through the cooperative movement of the fixed blade 41 and the movable blade 42, and is discharged to the discharge gap 63 (see FIG. 8).

As shown in FIG. 7, an elongated opening portion 68 through which the roll sheet 3A is inserted is provided on the rear frame 51. Both the right and the left end portions of the movable blade 42 extend upward with a substantially identical width into a gap between the right and the left side end portions of the opening portion 68 and the side wall portions 51A, 51B. And when the movable blade 42 is situated at the lowest position, each guide portion 42B and 42C are formed with the top end portion riding over on both the right and the left end portions of the fixed blade 41.

The fixed blade 41 longer than the lateral width of the opening portion 68 is screwed with screws 69, 69 to the top edge portion of the opening portion 68. The fixed blade 41 is fixed between the each side wall portion 51A and 51B on the front side in the conveyance direction. The tip of the fixed blade 41 is situated slightly below the top edge portion of the opening portion 68 so that it can make contact with an entire width of the roll sheet 3A.

When the roll sheet 3A printed at the thermal head 31 is discharged to the opening portion 68 of the cutter unit 8, the movable blade 42 is moved from the lowest position upward in the direction vertical to the conveyance direction by driving the cutting motor 43. The bottommost end portion of the V-shaped tip of the movable blade 42 is moved to a position which is above the bottom end portion of the fixed blade 41. Thereby, the roll sheet 3A which is carried to the opening portion 68, is cut over an entire width in the width direction by the cooperation of the movable blade 42 and the fixed blade 41.

On the other hand, when the cutting motor 43 is stopped, the movable blade 42 moves downward in a direction vertical to the conveyance direction from the cutting position to the bottommost position. At this time, the bottom edge portion of the opening portion 68 is located a little below than the bottommost end portion of the V-shaped tip of the movable blade 42.

Thus, when the cutting motor 43 is turned ON, the movable blade 42 comes into contact with the adhesive agent layer 3D of the printed roll sheet 3A, and cuts the roll sheet 3A by the cooperation with the fixed blade 41. Thereby, the adhesive agent on the adhesive agent layer 3D of the roll sheet 3A may accumulate on the movable blade 42.

Next, general description of the sheet discharging path portion 60 and the circumference thereof according to the embodiment will be described with reference to FIGS. 8 to 12.

Figure 8:
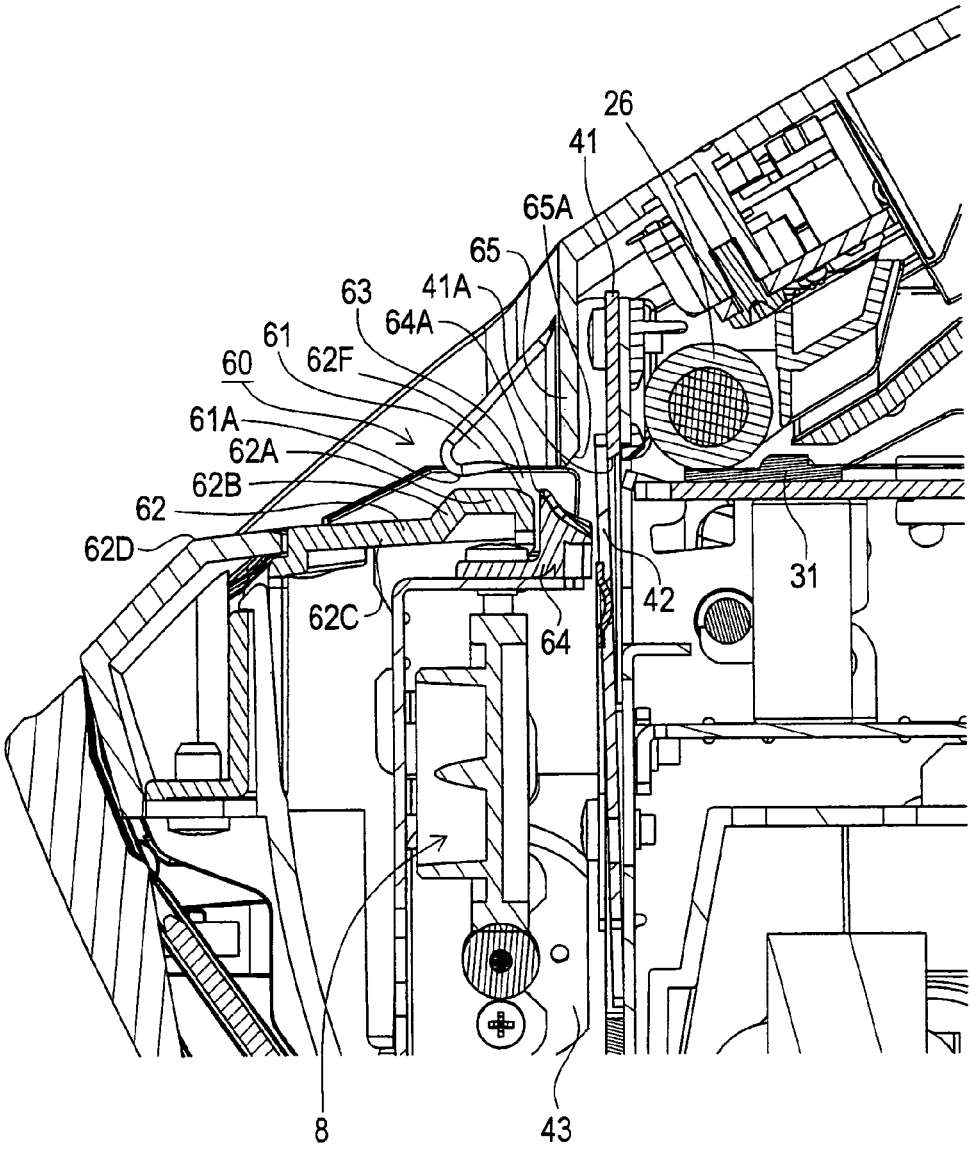
FIG. 8 is a sectional view showing the general description of the paper discharging path portion 60 and the circumference thereof according to the embodiment.
Figure 9:
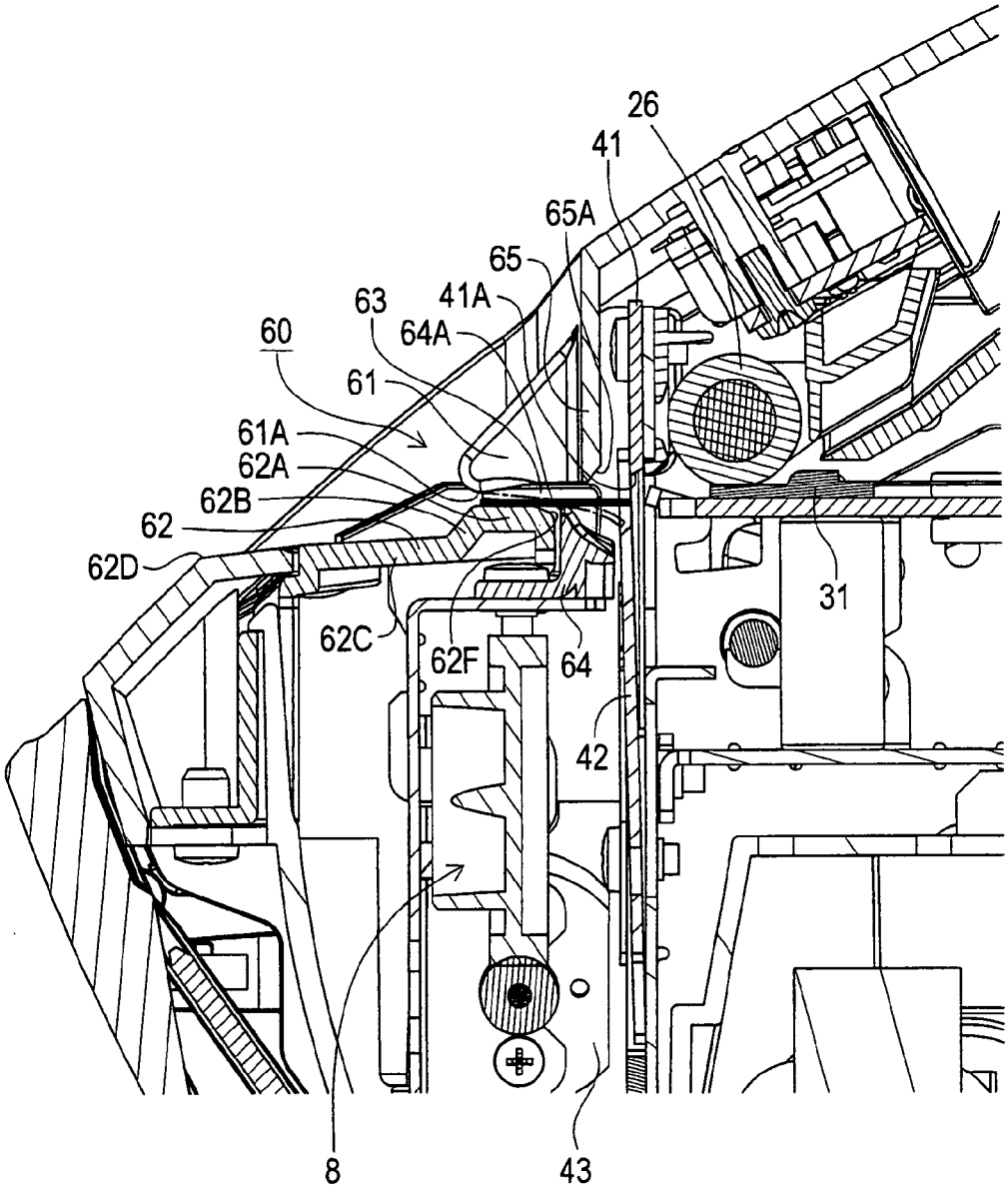
FIG. 9 is a pattern diagram showing a discharging path of the short roll sheet in the case adhesive agent adheres on the movable blade in the printing apparatus according to the embodiment.
Figure 10:
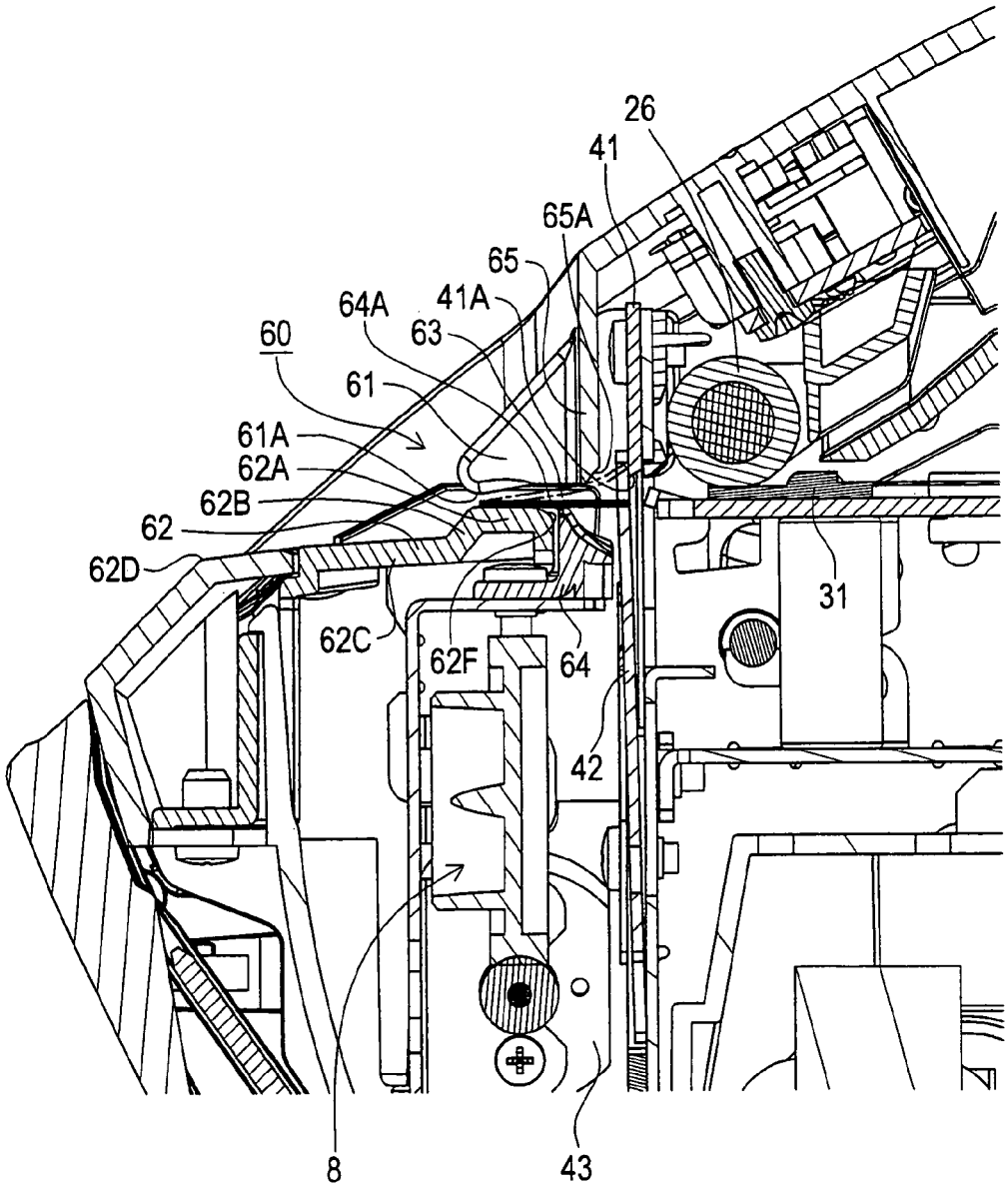
FIG. 10 is a pattern diagram showing a discharging path of the short roll sheet in the case adhesive agent adheres on the fixed blade in the printing apparatus according to the embodiment.
Figure 11:
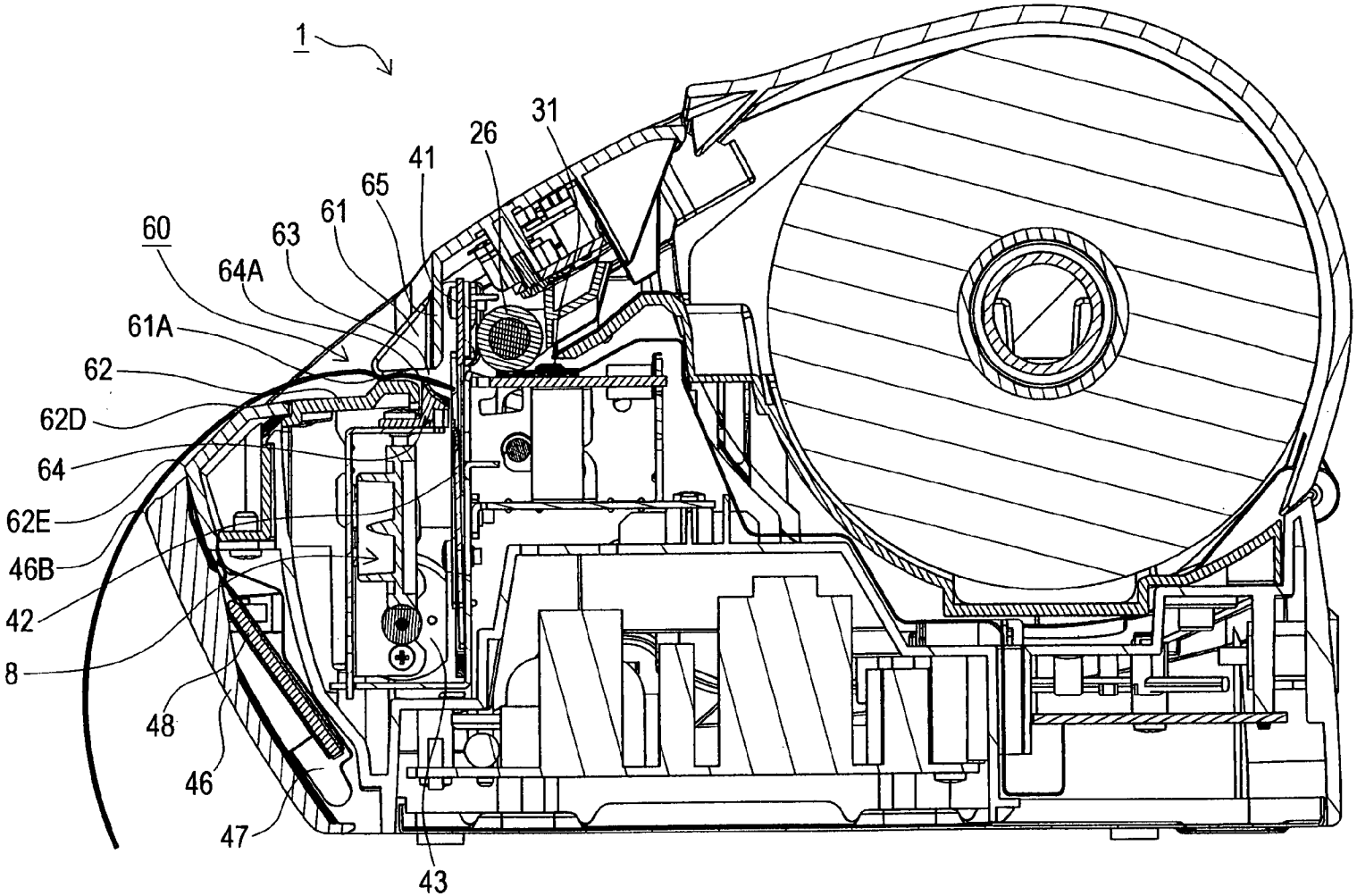
FIG. 11 is a pattern diagram showing a discharging path of the long size roll sheet in the printing apparatus according to the embodiment.
Figure 12:
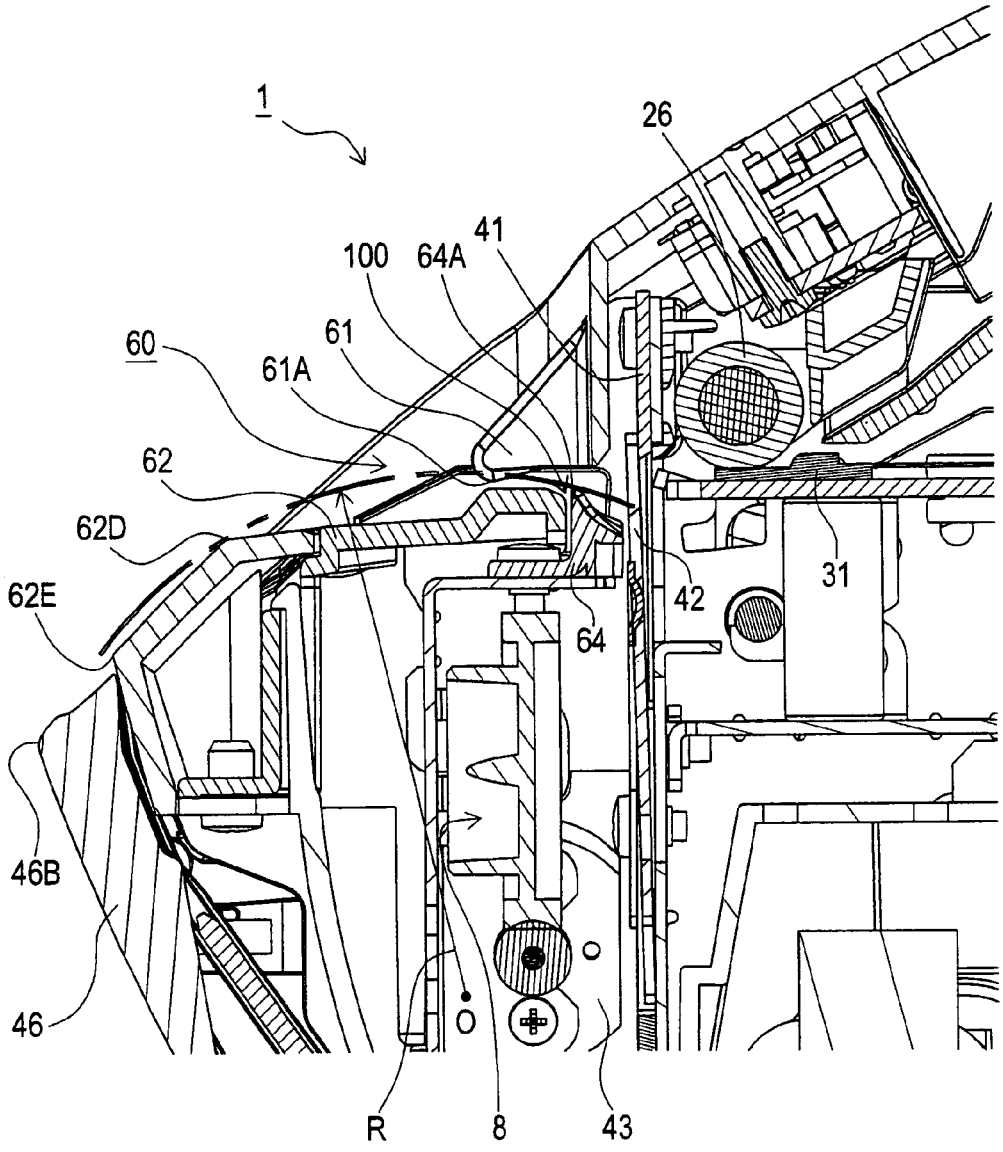
FIG. 12 is an enlarged pattern diagram showing a discharging portion in the case of the long size roll sheet in the printing apparatus according to the embodiment.

FIG. 8 is a sectional view showing the general description of the paper discharging path portion 60 and the circumference thereof according to the embodiment. FIG. 9 is a pattern diagram showing a discharging path of the short roll sheet in the case that the adhesive agent adheres on the movable blade in the printing apparatus according to the embodiment. FIG. 10 is a pattern diagram showing a discharging path of the short roll sheet in the case that the adhesive agent adheres to the fixed blade in the printing apparatus according to the embodiment. FIG. 11 is a pattern diagram showing a discharging path of the long size roll sheet in the printing apparatus according to the embodiment. FIG. 12 is an enlarged pattern diagram showing a discharging portion in the case of the long size roll sheet in the printing apparatus according to the embodiment.

As shown in FIG. 8 to FIG. 12, the sheet discharging path portion 60 is provided on the downstream side of the cutter unit 8. The sheet discharging path portion 60 includes a projecting portion 61, a regulatory member 62, a roll sheet receiving portion 64, and a rib 65. The projecting portion 61 is provided on the downstream side of the fixed blade 41, projecting toward the downstream side of the conveyance direction of the roll sheet 3A. The regulatory member 62 is provided on the downstream side of the movable blade 42. And the regulatory member 62 is a member having a stepwise structure, extending to the downstream side of the conveyance direction. The roll sheet receiving portion 64 is arranged between the movable blade 42 and the regulatory member 62, constructing the lower part of the sheet discharging path portion 60 together with the regulatory member 62. Also the roll sheet receiving portion 64 is a member to guide the roll sheet 3A in an obliquely upward direction. The rib 65 is arranged between the projecting portion 61 and the fixed blade 41, constructing the upper part of the sheet discharging path portion 60 together with the projecting portion 61.

The regulatory member 62 is parallel to the bottom face of the projecting portion 61. The regulatory member 62 extends to the downstream side along the conveyance direction by keeping a predetermined space with the bottom surface of the projecting portion 61 (about 1.2 mm in this embodiment). Further, as shown in FIGS. 8 to 12, the regulatory member 62 includes a horizontal part 62A, a sloping part 62B and a second horizontal part 62C. The sloping part 62B extends from the downstream side edge portion of the horizontal part 62A along the conveyance direction toward an obliquely downward direction. And the second horizontal part 62C extends from the bottom edge portion of the sloping part 62B horizontally toward the downstream side of the regulatory member 62.

A top edge portion 62D (corner portion) is formed on the downstream side of the second horizontal part 62C. The top edge portion 62D is on the front cover 6 connecting with the downstream side of the second horizontal part 62C. The top edge portion 62D is an edge portion of the front cover 6 which constructs a same surface with the second horizontal part 62C. Thereby, the regulatory member 62 has a stepwise structure including the horizontal part 62A, the sloping part 62B and the second horizontal part 62C. The position of the downstream side edge portion of the horizontal part 62A is determined by keeping the minimum length of the roll sheet 3A capably being made by the printing apparatus 1 as the horizontal distance from the cutting position. The tip of the projecting portion 61 projects toward the downstream side to the position almost the same as that of the downstream side edge portion of the horizontal part 62A.

The roll sheet 3A which is cut at the cutter unit 8 comes into contact with the inclined surface of the roll sheet receiving portion 64, and is guided toward an obliquely upward direction of the downstream side of the conveyance direction. Then the roll sheet 3A is guided to the discharging gap 63 which is on the downstream side of the roll sheet receiving portion 64. After passing the discharging gap 63, the roll sheet 3A is guided to the position between the projecting portion 61 and the regulatory member 62.

First, general description of the sheet discharging path portion 60 and the circumference thereof in the case that the short roll sheet 3A is made will be described with reference to FIGS. 8 to 10.

The short roll sheet 3A is cut at the cutter unit 8 and is discharged to the sheet discharging path portion 60. When the roll sheet 3A passes the discharging gap 63, the bottom side of the roll sheet 3A comes into contact with the rear edge portion of the regulatory member 62 on the sheet discharging path portion 60 or the top edge portion 64A of the roll sheet receiving portion 64, while the top side of the roll sheet 3A comes into contact with the bottom surface of the projecting portion 61. Accordingly, the movement of the roll sheet 3A is regulated. As a result, the roll sheet 3A is prevented from adhering to the adhesive agent on the movable blade 42, and the roll sheet 3A is also prevented from moving to the bottommost end portion of the movable blade 42.

Furthermore, when the length of the short roll sheet 3A is beyond the distance from the cutting position of the cutter unit 8 to the bottom edge portion 61A of the projecting portion 61, the top side of the short roll sheet 3A comes into contact with the bottom edge portion 61A of the projecting portion 61 instead of the bottom surface of the projecting portion 61. On the other hand, the bottom side of the roll sheet 3A comes into contact with the rear edge portion 62F of the regulatory member 62 or the top edge portion 64A of the roll sheet receiving portion 64.

In this case, the rear edge portion 62F of the regulatory member 62 or the top edge portion 64A of the roll sheet receiving portion 64 is almost at the same position with the bottom edge portion 61A of the projecting portion 61 on the open/close direction of the movable blade 42 toward the fixed blade 41 (up and down direction). In this embodiment, the rear edge portion 62F of the regulatory member 62 or the top edge portion 64A of the roll sheet receiving portion 64 is a little below the bottom edge portion 61A of the projecting portion 61 on the up/down direction. In another embodiment, the rear edge portion 62F of the regulatory member 62 or the top edge portion 64A of the roll sheet receiving portion 64 may be provided at the same position or a little above the bottom edge portion 61A of the projecting portion 61 on the up/down direction to keep the same discharging gap therebetween.

In detail, the movable blade 42 moves upward so as to cut the roll sheet 3A shortly. At that time, the edge portion on the upstream side along the conveyance direction of the roll sheet 3A, adheres to the movable blade 42 due to the adhesive agent on the movable blade 42. The movable blade 42 moves in a downward direction when the cutting of the roll sheet 3A is finished. At this time, the bottom side of the roll sheet 3A comes into contact with the rear edge portion 62F of the regulatory member 62 on sheet discharging path portion 60 or the top edge portion 64A of the roll sheet receiving portion 64, while the top side of the roll sheet 3A comes into contact with the bottom surface of the projecting portion 61. The part of the roll sheet 3A which comes into contact with the rear edge portion 62F of the regulatory member 62 or the top edge portion 64A of the roll sheet receiving portion 64 is defined as a first part of the roll sheet 3A, and the part of the roll sheet 3A which comes into contact with the bottom surface of the projecting portion 61 is defined as a second part of the roll sheet 3A.

To the short roll sheet 3A, the length from the upstream side edge portion to the first part, almost equals to the horizontal distance from the cutting position to the rear end portion 62F of the regulatory member 62 on sheet discharging path portion 60 or to the top edge portion 64A of the roll sheet receiving portion 64. And to the short roll sheet 3A, the length from the upstream side edge portion to the second part, is longer than the length from the upstream side edge portion the short roll sheet 3A to the first part. In other words, in case of the short roll sheet 3A, the second part is on the downstream side of the first part of the roll sheet 3A.

The roll sheet 3A on which the peeling paper 3E is bonded via the adhesive agent layer 3D has a predetermined elasticity. Thereby, when force in a downward direction is worked on the edge portion of the upstream side of roll sheet 3A through the movement of the movable blade 42, a force in a downward direction by the projecting portion 61 works on the second part of the top side of the roll sheet 3A, while a force in an upward direction by the rear edge portion 62F of the regulatory member 62 or the top edge portion 64A of the roll sheet receiving portion 64 works on the bottom side of the roll sheet 3A. Consequently, a reactive force to peel off the roll sheet 3A from the adhesive agent on the movable blade 42 is provided to the roll sheet 3A. As a result, the roll sheet 3A is prevented from adhering to the adhesive agent on the movable blade 42, and being drawn in to the bottommost end portion of the movable blade 42. Jam of roll sheet 3A at the sheet discharging path portion 60 is also prevented so that the roll sheet may be discharged certainly, and the discharging capability of the printing apparatus may be improved dramatically.

Also, when the roll sheet 3A cut by the cutter unit 8 is shorter, the possibility to be drawn in the printing apparatus by adhering to the adhesive agent on the movable blade 42 is higher. However, the adhesive power of the adhesive agent on the movable blade 42 is not very strong. Therefore, if the roll sheet 3A cut by the cutter unit 8 has a certain length, even when the roll sheet 3A adheres to the movable blade 42, the roll sheet may be peeled from the movable blade 42 due to its own weight without being drawn in the printing apparatus 1. On the other hand, when the roll sheet 3A cut by the cutter unit 8 is too short, since the own weight of the roll sheet 3A is too small, the roll sheet 3A still may be drawn in the printing apparatus 1.

In case of the long size roll sheet 3A, even when the roll sheet 3A is drawn in the printing apparatus 1, at the edge on the opposite side of the side being drawn in the printing apparatus 1, a part with a certain length sticks outside without being drawn in. Thereby, it is possible to pull the long size roll sheet 3A out by holding the sticking-out part. However, in case of the short roll sheet 3A, once the roll sheet 3A is drawn in the printing apparatus 1, the roll sheet 3A may be drawn completely in the printing apparatus 1, or the part which sticks outside is too short to be pulled out. As a result, it is really important to prevent the short roll sheet 3A from being drawn in the printing apparatus 1.

Next, as shown in FIG. 9, the regulatory member 62 has a stepwise structure including a horizontal part 62A, a sloping part 62B and a second horizontal part 62C. The position of the downstream side edge portion of the horizontal part 62A is determined by keeping the minimum length of the roll sheet 3A capably being made by the printing apparatus 1 as the horizontal distance from the cutting position. As a result, when the short roll sheet 3A is printed continuously, the roll sheet 3A which is printed previously maybe pushed out by the roll sheet 3A printed afterward. The roll sheet 3A discharged from the sheet discharging path portion 60 passes the sloping part 62B and is discharged to the exterior of the printing apparatus 1 smoothly without being piled up at horizontal part 62A of the sheet discharging path portion 60. Thus since the regulatory member 62 has a stepwise structure, the jam of the roll sheet 3A on the sheet discharging path portion 60 may be prevented, and the discharging capability of the printing apparatus may be improved dramatically.

Furthermore, as shown in FIG. 3, a predetermined space is provided between the two projecting portions 61 in this embodiment. When the roll sheet having a minimum width of the non-specified length is made, the left side projecting portion 61 on the roll sheet conveyance direction (the right side projecting portion 61 in FIG. 3), is provided in the middle of the minimum width of the non-specified length roll sheet. Accordingly, when the roll sheet having a minimum width of the non-specified length is made, the roll sheet 3A is pressed by the left side projecting portion 61. Thus, the roll sheet 3A is regulated by the projecting portion 61 and the regulatory member 62 or the top edge portion 64A of the roll sheet receiving portion 64. As a result, the roll sheet 3A may be discharged smoothly from the sheet discharging path portion 60.

On the other hand, when the non-specified length roll sheet with a wider width is made, the roll sheet 3A is pressed by both of the left and the right side projecting portions 61. As a result, the roll sheet 3A may be discharged smoothly from the sheet discharging path portion 60, and the discharging capability of the printing apparatus may be improved dramatically.

Thereby, because a predetermined space (for example, a space to which the fingers may be inserted) is provided between plural projecting portions 61. Even when the cut short roll sheet 3A gets jammed in the sheet discharging path portion 60, the roll sheet 3A may be pulled out simply by the user with hands, thus, the printing apparatus may be recovered easily from the jam of the roll sheet 3A at the sheet discharging path portion 60. And in the first place, the short roll sheet 3A is easily to be pulled out from the printing apparatus 1.

FIG. 10 is a pattern diagram showing a discharging path of the short roll sheet in the case that the adhesive agent adheres on the fixed blade in the printing apparatus according to the embodiment. As shown in FIG. 10, the rib 65, which is arranged on the upstream side of the projecting portion 61, constructs the upper part of the sheet discharging path portion 60 together with the projecting portion 61. The bottom edge portion 65A of the rib 65 is arranged lower than the bottommost edge portion 41A of the fixed blade 41 (the difference is about 0.5 mm to 1 mm in this embodiment).

The adhesive agent accumulated on the movable blade 42 may transfer to the fixed blade 41 due to the sliding movement between the fixed blade 41 and the movable blade 42. At this moment, the roll sheet 3A tends to adhere to the fixed blade 41 due to the adhesive agent (see the dotted and dashed line in FIG. 10). The bottom edge portion 65A of the rib 65 adjacent to the projecting portion 61 is arranged lower than the bottommost edge portion 41A of the fixed blade 41, thereby, the roll sheet 3A is pressed by the bottom edge portion 65A of the rib 65. As a result, the roll sheet 3A is prevented from adhering to the adhesive agent on the fixed blade 41.

In detail, only a little of the adhesive agent is adhered to the sliding part of the fixed blade 41 with the movable blade 42, most of the adhesive agent is accumulated on the portion adjacent to the sliding part which is located above the sliding part. Furthermore, since the tip of the movable blade 42 is V-shaped, the adhesive agent may also accumulate on the V-shaped tip.

When the roll sheet 3A is cut, the upstream side edge portion of the roll sheet 3A cut by the cutter unit 8 is likely to adhere to the fixed blade 41 by the adhesive agent on the fixed blade 41. Since only a little of the adhesive agent adheres to the sliding part of the fixed blade 41, the adhesive force is too weak to adhere the roll sheet 3A. The portion on which most of the adhesive agent accumulates on the fixed blade is above the sliding part. Supposedly, the roll sheet 3A tends to adhere to the fixed blade 41 at the portion on which most of the adhesive agent accumulates (see the dotted and dashed line in FIG. 10), the top face of the roll sheet 3A comes into contact with the bottom edge portion 65A of the rib 65, while the bottom face of the roll sheet 3A comes into contact with the top face of the horizontal part 62A on the regulatory member 62. The part of the roll sheet 3A which comes into contact with the bottom edge portion 65A of the rib 65 is defined as the third part of the roll sheet 3A, and the part of the roll sheet 3A which comes into contact with the top face of the horizontal part 62A on the regulatory member 62 is defined as the fourth part of the roll sheet 3A.

The length from the upstream side edge portion to the third part on the roll sheet 3A, almost equals to the horizontal distance from the cutting position to the rib 65. The length from the upstream side edge portion of the roll sheet 3A to the fourth part of the roll sheet 3A is longer than the length from the upstream side edge portion to the third part of the roll sheet 3A. In other words, the fourth part is on the downstream side of the third part. The roll sheet 3A on which the peeling paper 3E is bonded via the adhesive agent layer 3D has a predetermined elasticity.

The bottom edge portion 65A of the rib 65 is arranged lower than the bottommost edge portion 41A of the fixed blade 41. The portion on which most of the adhesive agent accumulates of the fixed blade 41 is the sliding part with the bottommost edge portion 41A. In other words, the adhesive agent accumulation portion is above the bottommost edge portion 41A of the fixed blade 41. Therefore, the adhesive agent accumulation portion is further separated from the bottom edge portion 65A of the rib 65 on the vertical direction of the conveyance direction.

In this situation, when the upstream side edge portion of the roll sheet 3A is to be raised to the height of the portion on the fixed blade 41 on which the adhesive agent is accumulated, a downward force is worked on the third part of the roll sheet 3A through the bottom edge portion 65A of the rib 65, and an upward force is worked on the fourth part of the roll sheet 3A through the top face of the horizontal part 62A on the regulatory member 62. As a result, the upstream side edge portion of the roll sheet 3A may not be raised to the height of the portion on which the adhesive agent of the fixed blade 41 is accumulated, and the roll sheet 3A may also not adhere to the fixed blade 41.

Furthermore, when the roll sheet 3A is wound in a small radius, since the roll sheet 3A is pulled out from the top side, the roll sheet 3A itself may curve in a downward direction. Thereby, the upstream side edge portion of the roll sheet 3A cut by the cutter unit 8 is not likely to be raised. However, when a long time has passed since the last usage of the printing apparatus 1, since the roll sheet 3A is maintained in a sandwiched state between the platen roller 26 and the thermal head 31, upward warpage occurs on one part of the roll sheet 3A. Only on the part of the roll sheet 3A where upward warpage occurs, there is some possibility to raise upstream side edge portion of the roll sheet 3A cut by the cutter unit 8. That is, the possibility to adhere the roll sheet 3A to the fixed blade 41 is small. It is because the bottom edge portion 65A of the rib 65 is arranged lower than the bottommost edge portion 41A of the fixed blade 41, therefore, the roll sheet 3A is prevented from adhering to the fixed blade 41 certainly.

As a result, the roll sheet 3A maybe discharged from the sheet discharging portion certainly, the jam of the roll sheet 3A at the cutter unit 8 may be prevented, and the discharging capability of the printing apparatus may be improved dramatically.

Next, general description of the sheet discharging path portion 60 and the circumference thereof when the long size roll sheet 3A is made, will be described with reference to FIGS. 11 and 12.

As shown in FIG. 12, when a circle with a center O and a predetermined radius R is drawn, wherein the circle passes the top edge portion 64A of the roll sheet receiving portion 64 and the top edge portion 62D on the downstream side of the regulatory member 62 (a circular arc which projects to a top side, see chain line in FIG. 12), the bottom edge portion 61A of the projecting portion 61 is always within the circle. Further, the predetermined radius R is within the range of the real radius of the roll sheet 3A which is wound around the roll sheet holder 3. And the center O is located below the top edge portion 64A of the roll sheet receiving portion 64 and the top edge portion 62D on the downstream side of the regulatory member 62.

The roll sheet 3A which is cut at the cutter unit 8 comes into contact with the sloping surface of the roll sheet receiving portion 64, and is guided in an obliquely upward direction to the downstream side of the conveyance direction. As shown in FIG. 11, on the rear end portion of the long size roll sheet 3A, the one surface is supported by the top edge portion 64A of the roll sheet receiving portion 64 and the top edge portion 62D on the downstream side of the regulatory member 62, while the other surface is pressed by the bottom edge portion 61A of the projecting portion 61. In other words, the long size roll sheet 3A passes between the top edge portion 64A of the roll sheet receiving portion 64 and the bottom edge portion 61A of the projecting portion 61, and also passes between the bottom edge portion 61A of the projecting portion 61 and the top edge portion 62D on the downstream side of the regulatory member 62.

Before the roll sheet 3A is cut, corresponding to its length, the downstream side tip of the roll sheet 3A may be hanging in the air, or may reach the installation surface on which the printing apparatus is installed, or may reach the top side of the tray member 46 which is in an open state. When the roll sheet 3A is further sent forth while it is hanging in the air, the downstream side tip face of the roll sheet 3A may finally come into contact with the installation surface or the tray member 46. At this time, if the roll sheet 3A bumps into the installation surface or the surface of the tray member 46 at an angle, when the roll sheet 3A is further sent forth, the roll sheet 3A may slip on the installation surface or the surface of the tray member 46 with the tip portion of the roll sheet 3A lying sideways.

In this situation, when the roll sheet 3A is cut, all of the roll sheet 3A which lose their supporting may slide and fall down the printing apparatus 1 on the installation surface or the surface of the tray member 46. Or if the gravity center of the roll sheet 3A discharged from the sheet discharge slot 6A, is on the rear part in the horizontal direction compared with the position of the downstream side tip, when the roll sheet 3A is cut, the roll sheet 3A may likely fall over toward the rear direction due to its own weight.

In another case, when the roll sheet 3A comes into contact with the installation surface or the downstream side end face of the tray member 46 from a hanging state, the roll sheet 3A may bump into installation surface or the surface of the tray member 46 in a vertical direction. In this case, since the roll sheet 3A has a predetermined elasticity, when the roll sheet 3A is further sent forth, the tip of the roll sheet 3A may bump into installation surface or the surface of the tray member 46 in a vertical direction without lying sideways.

In this case, when the roll sheet 3A is cut, the downstream side tip of the roll sheet 3A may maintain the vertical bumping state. Also, after the downstream side tip bumps into installation surface or the surface of the tray member 46 in a vertical direction, the roll sheet 3A itself may bend before being cut. Thus, when the roll sheet 3A is cut, the roll sheet 3A itself is likely to stretch. Or the gravity center of the roll sheet 3A discharged from the sheet discharge slot 6A, is on the rear part in the horizontal direction compared with the position of the downstream side tip. Thereby, when the roll sheet 3A is cut, the roll sheet 3A may likely fall over toward the rear direction due to its own weight.

Either in the case that the bended roll sheet 3A stretches or the roll sheet falls over toward the rear direction due to its own weight, it means that the tip of roll sheet 3A on the upstream side near the cutter unit 8 is likely to move toward the upstream side in the conveyance direction. At the vicinity of the rear end of the long size roll sheet 3A, if the roll sheet 3A is fixed on below three spots, the long size roll sheet 3A may be prevented from falling down to the movable blade 42. These three spots are the top edge portion 64A of the roll sheet receiving portion 64, the top edge portion 62D on the downstream side of the regulatory member 62, and the bottom edge portion 61A of the projecting portion 61. As a result, the long size roll sheet 3A is prevented from being cut twice.

In detail, when the long size roll sheet 3A is printed in the printing apparatus 1, the bottom surface of the long size roll sheet 3A (printing surface side) is supported by the top edge portion 64A of the roll sheet receiving portion 64 and the top edge portion 62D on the downstream side of the regulatory member 62, while the top surface (the platen roller 26 side) is pressed by the bottom edge portion 61A of the projecting portion 61. Thereby, on the two separated spots in the conveyance direction, upward forces are added to the roll sheet 3A from the bottom side, while on the spot between the two separated spots, a downward force is added to roll sheet 3A from the top side. Since the roll sheet 3A is wound around the roll sheet holder 3, it has a curving habit with a predetermined curvature. Furthermore, the curvature of the roll sheet 3A is bigger at the part nearer to the wound core of the roll sheet 3A.

On the other hand, from a center O, when a circular arc which passes the top edge portion 64A of the roll sheet receiving portion 64 and the top edge portion 62D on the downstream side of the regulatory member 62 (see chain line in FIG. 12) with a maximum radius R of the roll sheet 3A is drawn, the bottom edge portion 61A of the projecting portion 61 is always within the circular arc. In other words, when the roll sheet 3A having a predetermined elasticity which is in a bended state, is pressed from upside and downward in a direction vertical to the conveyance direction, a reactive force to return the roll sheet 3A to an original state is worked thereon. Thereby, the roll sheet 3A may be fixed on three spots, wherein these three spots are the top edge portion 64A of the roll sheet receiving portion 64, the top edge portion 62D on the downstream side of the regulatory member 62, and the bottom edge portion 61A of the projecting portion 61.

Hereinafter, the principle of fixing the roll sheet 3A on the three spots will be explained in detail. The position arrangement of the bottom edge portion 61A of the projecting portion 61 will be explained with reference to FIG. 13 and FIG. 14.

Figure 13:
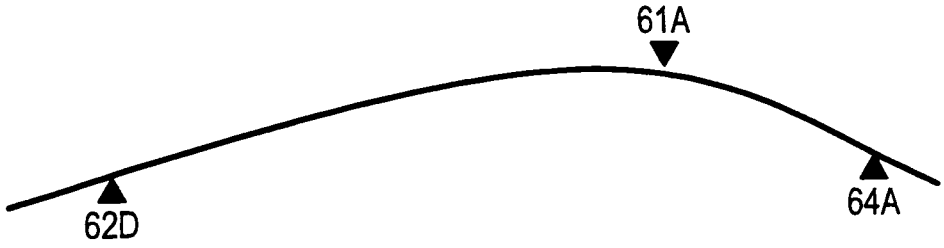
FIG. 13 is an explanation view for explaining the position regarding the bottom edge portion 61A of the projecting portion 61 in the printing apparatus according to the embodiment.

FIG. 13 is an explanation view for explaining the position regarding the bottom edge portion 61A of the projecting portion 61 in the printing apparatus according to this embodiment. FIG. 13 is a pattern view showing the case in which the bottom edge portion 61A of the projecting portion 61 is provided on the downstream side proximity of the top edge portion 64A of the roll sheet receiving portion 64.

Figure 14:
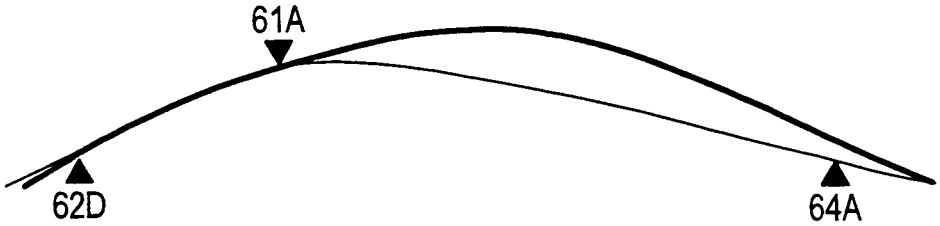
FIG. 14 is an explanation view for explaining the case in comparison with the position regarding the bottom edge portion 61A of the projecting portion 61 in the printing apparatus according to the embodiment.

FIG. 14 is an explanation view for explaining the case in comparison with the position regarding the bottom edge portion 61A of the projecting portion 61 in the printing apparatus according to this embodiment. FIG. 14 is a pattern view showing the case in which the bottom edge portion 61A of the projecting portion 61 is provided on the upstream side proximity of the top edge portion 62D on the downstream side of the regulatory member 62.

In FIG. 11 and FIG. 13, the bottom edge portion 61A of the projecting portion 61 is provided on the downstream side proximity of the top edge portion 64A of the roll sheet receiving portion 64. In this case, the distance between the bottom edge portion 61A of the projecting portion 61 and the top edge portion 64A of the roll sheet receiving portion 64, is quite shorter than the distance between the bottom edge portion 61A of the projecting portion 61 and the top edge portion 62D on the downstream side of the regulatory member 62.

In above case, since the distance between the bottom edge portion 61A of the projecting portion 61 and the top edge portion 64A of the roll sheet receiving portion 64 is short, the roll sheet 3A has a relatively strong elasticity, thereby the roll sheet 3A may easily cross the projecting portion 61. Also because the distance between the bottom edge portion 61A of the projecting portion 61 and the top edge portion 64A of the roll sheet receiving portion 64 is short, the roll sheet 3A is not likely to bend between the bottom edge portion 61A of the projecting portion 61 and the top edge portion 64A of the roll sheet receiving portion 64.

Furthermore, even when the roll sheet 3A bends between the bottom edge portion 61A of the projecting portion 61 and the top edge portion 64A of the roll sheet receiving portion 64, because the distance between the bottom edge portion 61A of the projecting portion 61 and the top edge portion 64A of the roll sheet receiving portion 64 is short, the length of the bended part is short, therefore, the end portion on the upstream side of the roll sheet 3A is not likely to be cut twice.

As a result, the end portion on the upstream side of the long size roll sheet 3A may not return to the upstream side of the conveyance direction due to its own weight, and also long size roll sheet 3A may be prevented from being cut twice by the cutter unit 8.

On the other hand, in FIG. 14, the case in which the bottom edge portion 61A of the projecting portion 61 is provided on the upstream side proximity of the top edge portion 62D on the downstream side of the regulatory member 62. In this case, the distance between the bottom edge portion 61A of the projecting portion 61 and the top edge portion 64A of the roll sheet receiving portion 64, is quite longer than the distance between the bottom edge portion 61A of the projecting portion 61 and the top edge portion 62D on the downstream side of the regulatory member 62.

In the case as shown in FIG. 14, since the distance between the bottom edge portion 61A of the projecting portion 61 and the top edge portion 64A of the roll sheet receiving portion 64 is long, the roll sheet may bend between the bottom edge portion 61A of the projecting portion 61 and the top edge portion 64A of the roll sheet receiving portion 64 (see the heavy-line in FIG. 14). In this state, when the roll sheet 3A is cut, the bended part tends to stretch so that the roll sheet 3A may return to its original state. Thereby, the end portion on the upstream side of the long size roll sheet 3A (the right end portion in FIG. 14) may return to the upstream side in the conveyance direction, and thus the roll sheet 3A is cut twice by the cutter unit 8. Further, the light-line in FIG. 14 shows the ideal conveyance path in which the roll sheet 3A does not bend.

As explained above, in order to prevent the end portion on the upstream side of the long size roll sheet 3A from returning to the upstream side in the conveyance direction due to its own weight, it is necessary to arrange the bottom edge portion 61A of the projecting portion 61 on the downstream side proximity of the top edge portion 64A of the roll sheet receiving portion 64.

Accordingly, when the bottom edge portion 61A of the projecting portion 61 is provided on the downstream side proximity of the top edge portion 64A of the roll sheet receiving portion 64, the long size roll sheet 3A may be supported on three spots from the up-and-down direction vertical to the conveyance direction of the roll sheet 3A. These three spots are the top edge portion 64A of the roll sheet receiving portion 64, the top edge portion 62D on the downstream side of the regulatory member 62, and the bottom edge portion 61A of the projecting portion 61. As a result, the cut long size roll sheet 3A may be prevented from falling over to the movable blade 42, and the long size roll sheet 3A may be prevented from being cut twice.

When the tray member 46 is closed, an edge portion 46B (corner portion) at the top of the tray member 46 locates on the hithermost position of the printing apparatus 1. The edge portion 46B is also on the circumference which starts from a center O with a predetermined radius R, wherein the circumference passes the top edge portion 64A of the roll sheet receiving portion 64 and the top edge portion 62D on the downstream side of the regulatory member 62. Thus, even when the edge portion 46 B comes into contact with the roll sheet 3A instead of the top edge portion 62D, the effect to fix the roll sheet 3A may also be effective.

Adjacent to the concave portion 46A of the tray member 46 in a closed state, an edge 62E (corner portion, see FIG. 11) is formed on the front cover 6 on the downstream side of the top edge portion 62D. When the tray member 46 is opened, the edge 62E locates on the hithermost position of the printing apparatus 1 except the tray member 46. The edge portion 62E is also on the circumference which starts from a center O with a predetermined radius R, wherein the circumference passes the top edge portion 64A of the roll sheet receiving portion 64 and the top edge portion 62D on the downstream side of the regulatory member 62. Thus, even when the edge portion 62E comes into contact with the roll sheet 3A instead of the top edge portion 62D, the effect to fix the roll sheet 3A may also be effective.

Thus, in this embodiment, the sheet discharging path portion 60 includes a projecting portion 61, a regulatory member 62, a roll sheet receiving portion 64, and a rib 65. When short roll sheet 3A is discharged from the cutter unit 8 to the sheet discharging path portion 60, one surface of the roll sheet 3A comes into contact with the rear edge portion 62F of the regulatory member 62 on sheet discharging path portion 60 or the top edge portion 64A of the roll sheet receiving portion 64, while the other surface of the roll sheet 3A comes into contact with the bottom edge of the projecting portion 61. Thus, the discharging path of the roll sheet 3A is regulated. As a result, the roll sheet 3A is prevented from moving to the bottommost end portion of the movable blade 42 together with the adhesive agent.

Furthermore, the bottom edge portion 65A of the rib 65 constructing the upper part of the sheet discharging path portion 60 with the projecting portion 61, is provided lower than the bottommost edge portion 41A of the fixed blade 41. Thus the roll sheet 3A is regulated between the projecting portion 61 and the rib 65, as a result, the roll sheet 3A is prevented from adhering to the adhesive agent on the fixed blade 41. Therefore, the jam of the roll sheet 3A at the cutter unit 8 may be prevented, and the discharging capability of the printing apparatus may be improved dramatically.

When the long size roll sheet 3A discharged from the cutter unit 8 to the sheet discharging path portion 60, one surface of the long size roll sheet 3A is supported by the top edge portion 64A of the roll sheet receiving portion 64 and the top edge portion 62D on the downstream side of the regulatory member 62, while the other surface is pressed by the bottom edge portion 61A of the projecting portion 61. Thereby, the roll sheet 3A is discharged from the sheet discharging path portion 60 smoothly, the accumulation of the roll sheet 3A at the sheet discharging path portion 60 may be prevented. As a result, the jam due to the accumulation of the roll sheet 3A may be prevented, and the discharging capability of the printing apparatus may be improved dramatically.

Needless to say, the present disclosure is not restricted to the above-described embodiment but may be improved or modified in various ways within a range not departing from the spirit of the disclosure.

For example, the projecting portions 61, 61 may also use thick members on the direction vertical to the conveyance direction with a predetermined space therebetween, or may use plural rib members with thin width. The projecting portion 61 may be improved or modified in various ways if the projecting portion 61 is capable to press the roll sheet corresponding to the minimum roll sheet width when short non-specified length roll sheet is made.

The cutting method is not only limited to the guillotine cutter, it may also be applicable in the sliding cutter and the other cutting method.

This disclosure may also be applied to the cutting plotter and the other sheet processing apparatuses besides the printing apparatus.

For the construction of peeling the roll sheet 3A which adheres to the movable blade 42 by the adhesive agent on the movable blade 42, it is not always limited to the construction in which the movable blade 42 is on the bottom side while the fixed blade 41 is on the top side. In other words, the movable blade 42 may be on the top side and the fixed blade 41 may be on the bottom side. In this case, the bottom edge portion 65A of the rib 65 may come into contact with the first part of the short roll sheet 3A instead of the rear edge portion 62F of the regulatory member 62 on sheet discharging path portion 60 or the top edge portion 64A of the roll sheet receiving portion 64, while the horizontal part 62A on the regulatory member 62 may come into contact with the second part of the short roll sheet 3A instead of bottom face of the projecting portion 61.

Also, in the same way, for the construction to prevent the roll sheet 3A cut by the cutter unit 8 from adhering to the fixed blade 41 by the adhesive agent on the fixed blade 41, it is not limited to the construction in which the movable blade 42 is on the bottom side and the fixed blade 41 is on the top side.

Furthermore, in this embodiment, the regulatory member 62 or the roll sheet receiving portion 64 is constructed individually, the regulatory member 62 and the roll sheet receiving portion 64 may also be integrated. Also the projecting portion 61 or the rib 65 is constructed individually in this embodiment, the projecting portion 61 and the rib 65 may also be integrated.

In this embodiment, the topmost end position of the rear edge portion 62F on the upstream side of the regulatory member 62 is almost the same as that of the top edge portion 64A of the roll sheet receiving portion 64. Thereby, the long size roll sheet 3A is prevented from being cut twice by fixing the roll sheet 3A at three spots, wherein the three spots are the top edge portion 64A of the roll sheet receiving portion 64, the top edge portion 62D on the downstream side of the regulatory member 62, and the bottom edge portion 61A of the projecting portion 61.

However, in another embodiment, the topmost edge position on the top edge portion 64A of the roll sheet receiving portion 64 may be constructed a little below than the topmost end position of the rear edge portion 62F on the upstream side of the regulatory member 62. In this case, the long size roll sheet 3A may be at three spots, wherein the three spots are the rear edge portion 62F on the upstream side of the regulatory member 62, the top edge portion 62D on the downstream side of the regulatory member 62, and the bottom edge portion 61A of the projecting portion 61.

As explained above, in this disclosure, the conveyance path member 100 (see FIG. 12) indicates the regulatory member 62 or the roll sheet receiving portion 64. The conveyance path member 100 includes a first top edge portion and a second top edge portion. The first top edge portion which is provided on the downstream side proximity of the cutter unit 8 in the sheet conveyance direction, while the second top edge portion is provided on the downstream side proximity of the first top edge portion in the sheet conveyance direction.

In the embodiment, the first top edge portion of the conveyance path member 100 indicates the top edge portion 64A of the roll sheet receiving portion 64, it may also indicate the rear edge position 62F on the upstream side of the regulatory member 62. And the second top edge portion of the conveyance path member 100 indicates the top edge portion 62D on the downstream side of the regulatory member 62.

While the presently exemplary embodiment has been shown and described, it is to be understood that this disclosure is for the purpose of illustration and that various changes and modification may be made without departing from the scope of the disclosure as set forth in the appended claims.

What is claimed is:

1. A sheet processing apparatus comprising:

a main body loaded with a roll sheet;

a cutting device for cutting an unwound sheet material from the roll sheet arranged in the main body, the cutting device comprising a fixed blade and a movable blade; and a sheet discharging path portion comprising a first regulatory member and a second regulatory member;

wherein the unwound sheet material from the roll sheet is formed from an adhesive agent layer and a peeling paper which is bonded to the adhesive agent layer, the fixed blade is arranged to make contact with one side of the unwound sheet material from the roll sheet across its entire width, the movable blade is arranged to be capable of being open/close throughout the entire width of the other side of the unwound sheet material, the sheet discharging path portion is arranged on a downstream side of the cutting device, and has a conveyance path for discharging the unwound sheet material from the roll sheet cut by the cutting device to an exterior, the first regulatory member is arranged on a side of the movable blade across the conveyance path for the unwound sheet material from the roll sheet cut by the cutting device, the second regulatory member is arranged on a side of the fixed blade across the conveyance path for the unwound sheet material from the roll sheet cut by the cutting device, one of the first regulatory member and the second regulatory member has a bottom side of the sheet discharging path portion, the other of the first regulatory member and the second regulatory member has a top side of the sheet discharging path portion, the first regulatory member comprises a first contacting portion with which the unwound sheet material from the roll sheet cut by the cutting device is adhered to the movable blade by an adhesive agent with which it makes contact, in proximity of the cutting device when the movable blade opens, the second regulatory member comprises a second contacting portion with which the unwound sheet material from the roll sheet cut by the cutting device adhered to the movable blade by the adhesive agent makes contact, on a downstream side of the first contacting portion when the movable blade opens, the one of the first regulatory member and the second regulatory member which has the bottom side of the sheet discharging path portion comprises a first top edge portion arranged proximal the downstream side of the cutting device in a sheet conveyance direction, the one of the first regulatory member and the second regulatory member which has the bottom side of the sheet discharging path portion comprises a second top edge portion arranged on a downstream side of the first top edge portion in the sheet conveyance direction, the one of the first regulatory member and the second regulatory member which has the top side of the sheet discharging path portion comprises a bottom edge portion arranged between the first top edge portion and second top edge portion, the unwound sheet material from the roll sheet cut by the cutting device passes between the first top edge portion and the bottom edge portion, and passes between the second top edge portion and the bottom edge portion, when a circular arc is drawn with a predetermined radius so as to project upward and pass both the first top edge portion and the second top edge portion, and the bottom edge portion is positioned inside the circular arc; and wherein the predetermined radius is a maximum radius of the roll sheet.

2. The sheet processing apparatus according to claim 1, wherein the second regulatory member further comprises a third contacting portion with which the unwound sheet material from the roll sheet cut by the cutting device makes contact in proximity of the cutting device, the third contacting portion is arranged on a side which is closer to the movable blade than an edge portion of the fixed blade at a movable blade side in an open close direction of the movable blade.

3. The sheet processing apparatus according to claim 2, wherein the first regulatory member extends toward a downstream side in a conveyance direction of the unwound sheet material from the roll sheet, the first regulatory member further comprises a horizontal part facing the second regulatory member, on a downstream side of the third contacting portion of the second regulatory' member in the conveyance direction of the unwound sheet material from the roll sheet.

4. The sheet processing apparatus according to claim 1, wherein the one of the first regulatory member and the second regulatory member having the bottom side of the sheet discharging path portion has a stepwise structure, the stepwise structure comprises a sloping part extending toward an obliquely downward direction along the conveyance direction of the unwound sheet material from the roll sheet.

5. The sheet processing apparatus according to claim 1, wherein the one of the first regulatory member and the second regulatory member having the top side of the sheet discharging path portion is formed from plural ribs with a predetermined space therebetween.

6. A sheet processing apparatus comprising:

a main body loaded with a roll sheet;

a cutting device for cutting an unwound sheet material from the roll sheet arranged in the main body: and a sheet discharging path portion for discharging the unwound sheet material from the roll sheet cut by the cutting device to an exterior, the sheet discharging path portion comprising, a first regulatory member, a second regulatory member, a first top edge portion of the first regulatory member, a second top edge portion of the first regulatory member, and a bottom edge portion of the second regulatory member, wherein the sheet discharging path portion is arranged on a downstream side of the cutting device, the first regulatory member is arranged on a bottom side of the sheet discharging path portion across a conveyance path, the second regulatory member is arranged on a top side of the sheet discharging path portion across the conveyance path, the first top edge portion of the first regulatory member is arranged in proximity of the downstream side of the cutting device in a sheet conveyance direction, the second top edge portion of the first regulatory member is arranged on a downstream side of the first top edge portion of the first regulatory member in the sheet conveyance direction, the bottom edge portion of the second regulatory member is between the first top edge portion and the second top edge portion of the first regulatory member, the unwound sheet material from the roll sheet cut by the cutting device passes between the first top edge portion of the first regulatory member and the bottom edge portion of the second regulatory member, and passes between the second top edge portion of the first regulatory member and the bottom edge' portion of the second regulatory member, when a circular arc is drawn with a predetermined radius so as to project upward and pass both the first top edge portion and the second top edge portion of the first regulatory member, and the bottom edge portion of the second regulatory member is positioned inside the circular arc, and wherein the predetermined radius is a maximum radius according to which the unwound sheet material is wound into the roll sheet.

* * * * *